US009211233B2

(12) United States Patent
Shavelsky et al.

(10) Patent No.: US 9,211,233 B2
(45) **Date of Patent: *Dec. 15, 2015**

(54) INTERACTIVE MEDICATION DISPENSING SYSTEM

(75) Inventors: Eran Shavelsky, Newton, MA (US); Woodie C. Flowers, Weston, MA (US); Justin F. Aiello, Kennebunk, ME (US)

(73) Assignee: MedMinder Systems, Inc., Newton, MA (US)

( * ) Notice: Subject to any disclaimer, the term of this patent is extended or adjusted under 35 U.S.C. 154(b) by 512 days.

This patent is subject to a terminal disclaimer.

(21) Appl. No.: 13/488,117

(22) Filed: Jun. 4, 2012

(65) Prior Publication Data

US 2013/0002795 A1 Jan. 3, 2013

Related U.S. Application Data

(63) Continuation-in-part of application No. 12/606,643, filed on Oct. 27, 2009, now Pat. No. 8,193,918.

(60) Provisional application No. 61/197,859, filed on Oct. 31, 2008.

(51) Int. Cl.

| | |
|---|---|
| ***G08B 1/00*** | (2006.01) |
| ***A61J 7/04*** | (2006.01) |
| *A61J 7/00* | (2006.01) |

(52) U.S. Cl.

CPC . *A61J 7/04* (2013.01); *A61J 7/0069* (2013.01); *A61J 7/0436* (2015.05)

(58) Field of Classification Search

CPC ..... A61J 7/04; A61J 7/0069; A61J 7/0436
USPC ..... 340/572.1, 309.1, 573.1; 368/10; 700/242, 236, 241, 244
See application file for complete search history.

(56) References Cited

U.S. PATENT DOCUMENTS

| | | | |
|---|---|---|---|
| 4,693,371 | A | 9/1987 | Malpass |
| 5,159,581 | A | 10/1992 | Agans |

(Continued)

FOREIGN PATENT DOCUMENTS

| | | | |
|---|---|---|---|
| CA | 2261424 | A1 | 8/2000 |

OTHER PUBLICATIONS

O'Connor, "Improving Medication Adherence: Challenges for Physicians, Payers, and Policy Makers", Sep. 25, 2006, pp. 1802-1804, vol. 166, No. 17, Published in: US.

(Continued)

*Primary Examiner* — Daryl Pope
(74) *Attorney, Agent, or Firm* — Loginov & Associates, PLLC; William A. Loginov

(57) ABSTRACT

This invention provides a medication dispensing system that instructs the user through visual and audio cues, such as the illumination of individual medication cups that are arrayed in accordance with a daily and weekly schedule in separate orifices within the dispenser body. It monitors compliance by determining when an indicated cup is accessed, based upon at least one of manipulating a lid and/or placing into, removing from, or replacing into the correct orifice based upon the indication. The cups can be refilled based upon an indication, and/or can be provided in removable prefilled refill tray. The dispenser can include an on-board processor that stores a current configuration including the treatment schedule. The configuration can be programmed/re-programmed, and compliance can be monitored, via a wired or wireless server connection that communicates with interested parties, and that supports a graphical user interface. Communication, messaging and/or display systems can also be integrated.

21 Claims, 29 Drawing Sheets

(56) References Cited

U.S. PATENT DOCUMENTS

| | | | | |
|---|---|---|---|---|
| 5,710,551 | A | 1/1998 | Ridgeway | |
| 5,954,225 | A | 9/1999 | Powe | |
| 6,457,611 | B1 | 10/2002 | Koehler | |
| 7,369,919 | B2 | 5/2008 | Vonk et al. | |
| 8,193,918 | B1 * | 6/2012 | Shavelsky et al. | 340/309.16 |
| 2002/0149472 | A1 | 10/2002 | Roe | |
| 2008/0164272 | A1 | 7/2008 | Dallman | |
| 2010/0049361 | A1 | 2/2010 | Bertrand et al. | |

OTHER PUBLICATIONS

Harrisinteractive, "Prescription Drug Compliance a Significant Challenge for Many Patients, According to New National Survey", Mar. 29, 2005, Publisher: HarrisInteractive, Published in: US.

Col, et al., "The Role of Medication Noncompliance and Adverse Drug Reactions in Hospitalizations of the Elderly", Apr. 1990, pp. 841-845, vol. 150, No. 4, Publisher: Archives of Internal Medicine, Published in: US.

* cited by examiner

INTERACTIVE MEDICATION DISPENSING SYSTEM

RELATED APPLICATIONS

This application is a continuation-in-part of U.S. patent application Ser. No. 12/606,643, entitled INTERACTIVE MEDICATION DISPENSING SYSTEM, by Eran Shavelsky, Woodie C. Flowers, Justin Aiello, filed Oct. 27, 2009, which claims the benefit of U.S. Provisional Application Ser. No. 61/197,859, entitled INTERACTIVE MEDICATION DISPENSING SYSTEM, by Eran Shavelsky, Woodie C. Flowers, Justin Aiello, filed Oct. 31, 2008, the teachings of each of which applications is expressly incorporated herein by reference.

FIELD OF THE INVENTION

This invention relates to systems and methods for ensuring compliance by a patient in taking scheduled medications.

BACKGROUND OF THE INVENTION

Poor adherence to medication schedules is a recognized medical problem, costing an estimated $100 billion a year (Improving Medication Adherence, Archives of Internal Medicine 2006, 166:1802-1804). Failing to comply with pharmacological therapies leads to over approximately 125,000 deaths in the US each year, twice the number of people killed in automobile accidents (http://www.harrisinteractive-.com/news/allnewsbydate.asp?NewsID=904). Almost 30% of all hospital admissions for people over the age of 65 are directly attributable to medication non-compliance (Archives of Internal Medicine 1990; 150: 841-845). Nearly $48 billion in annual costs result from unnecessary medication-induced hospitalization (Archives of Internal Medicine—October 1995). Approximately 40% of people entering nursing homes do so because they are unable to self-medicate in their own homes (Feasibility Study, Biomedical Business International, January 1988). About one-half of the 1.8 billion prescriptions dispensed annually are not taken correctly, contributing to prolonged or additional illnesses (Medications and the Elderly, Ch. 4 pp 67-68, 75).

Care management and Health Plans currently rely on labor-intensive and costly intervention programs to improve medication compliance. Directly Observed Therapy (DOT) programs employ a health care worker to directly administer, observe and document a patient's ingestion of a medication.

Patients who must take medication in pill form often use a multi-compartment pillbox to help organize the task of taking the proper medication at the proper time. Patients who must take many pills per day at different times of the day frequently use a daily manual pillbox that has four compartments for one day. These compartments are designated AM, NOON, PM, Bed, or Breakfast, Lunch, Dinner, Bed, or some other set of designations, for instance, by time. The four compartments may be integral, or may be individual small boxes that are retained in a day-frame, so that each can be individually manipulated. Pill organizers typically may have seven of such daily four compartment boxes, arranged according to the seven days of the week. Such weekly organizers may typically include a frame that removably retains each of seven daily pillboxes, so that each one can be individually removed and manipulated. Rather than four compartments, a daily system may have more or less compartments, depending on the complexity of the patient's medication regime.

Such manual medication systems are simple, and have both advantages and disadvantages. The advantages include that they are inexpensive and relatively easy to set up and use. A patient or a patient's aid determines which medications are required for each day, and the times of the day that they are required. The required pills are placed into the corresponding compartments, the compartments are closed and each day-set is put into the week-frame for safe-keeping. The patient or the patient's aid opens the appropriate compartment at the appointed times, removes the medication, and the patient consumes it. It is refilled with the proper medications at some time before the next day or week when the compartment or day-set is required to be used again and the process begins again. Other advantages are that the day-set or week-frame can be relatively easily transported to accompany the patient if the patient needs to be away from home for a day or more. They can be cleaned relatively easily. They are arranged physically in a manner that mimics a daily organizer, such as a calendar or a day-planner, and thus, are not confusing, typically, as to which medication has been designated to be taken at which time(s).

Medication organizing equipment as described above does have disadvantages. Some disadvantages relate to loading the medications into the equipment, and some relate to removing the medications. Further, these manual systems provide only rudimentary record keeping functions. Turning first to the loading disadvantages, many patients are on complicated medication regimes, and thus, it may be complicated to ensure that the correct medication is placed in the compartment that corresponds to the correct time to take that medication. Duplicate pill placement may take place, which may result in an overdose. Or, a placement may be inadvertently omitted, which might result in an under dose. Some patients may find it psychologically daunting to face the task of organizing all of the medications. Or they may simply be unable to do so cognitively, especially if their condition affects their cognition.

Turning to the dispensing disadvantages, a typical day-set contains four compartments, and a typical week-set contains seven day-sets, for a total of twenty-eight dose medication compartments. A patient might become confused as to which medication compartment to use at any given time. Even if not confused, a patient might open a medication compartment from the correct day, but the wrong time, or, perhaps, the correct time, but from the wrong day of the week (for instance, regarding a medication that is taken only every other day, or for three consecutive days, but not the following four). A patient may forget to take any medication at a prescribed time, may open a wrong compartment or may simply not take the medication for another reason. Additionally, a patient might forget that they have taken a given dose of medication, and might take an additional dose. If two people share responsibility for a patient, including, perhaps, the patient himself/herself, both people might give the patient a dose of the same medication, erroneously, resulting in an overdose.

Further disadvantages relate to the lack of real time remote visibility for caregivers or third parties to monitor compliance with the medication schedule. It is also beneficial to generate accurate records reflecting when medication has been taken, or accessed, and what medication has been taken.

In recent years, automated and semi-automated systems have been developed. Many of these systems have disadvantages of their own. They typically have many and complicated features. The user interfaces are overly complicated, and include multiple data read-outs and opportunities for input, similar in complexity to media recording equipment, or kitchen appliances, many of which remain un-programmed, with some features unused. Such systems intimidate and confuse many users, particularly elderly and infirm who require significant amount of medication at specific times. Ironically, the more one is in need of the system, due to the complexity of their drug regime, the greater the probability that they might be unable to use such a modern system. They are difficult to set-up and to program the drug regime. They are sometimes also difficult to use for dispensing medication, because of complex user interaction controls.

Advances in telecommunications have made possible the integration of various systems into smaller devices. Telephones and other handheld electronic devices have been furnished with micro-recording devices, small media recorders and linked to the internet to provide a capability for real-time media links. Vulnerable patients now find themselves in instant communication with service providers in case of accidents. This is particularly useful in promoting independence and self-reliance among those individuals. But while this is convenient, it can lead to a plurality of devices with overlapping telecommunications capabilities, providing potential confusion to less-functional users.

It is therefore desirable to provide a medication dispensing apparatus and system that is straightforward and simple to load with medication. There is also need for such a system from which it is straightforward and simple to dispense medication in proper doses at the proper times. This medication apparatus and system should identify which of many individual dose medication compartments should be used at a given time. It is further desirable that the medical apparatus and system should remind a user that it is time to take medication, and, continue to remind the user until the medication is taken. There is a further need for a system to remind patients to take their medication through various auditory, visual and other cues, and that notifies a third party if the patient does not take the medication or takes the wrong set of medication for a given time period. It is desirable that such a system notifies third parties who are in the same location as the patient, as well as at a distant location if the patient fails to take the required medication. It is desirable that an apparatus in which all of the dose compartments for an entire week, or other long-range time period can be opened and closed together as a group and easily refilled. It is desirable that such a system have a simple user interface, without the need to read text or interpret complex light or sound codes, and that presents minimal or no risk of accidental reprogramming after set-up, and whose setup can be remotely changed in a real-time manner. It is also desirable to reduce the number of devices requiring attention for the convenience of the user (e.g., the patient) and for health and safety. Lastly, it is desirable that such a system provides flexible real time and periodic compliance and non-compliance reporting, and integrates with external medical health record keeping systems.

SUMMARY OF THE INVENTION

This invention overcomes the disadvantages of the prior art by providing a medication dispensing system and method that is straightforward to use, and provides clear indications of the user's (patient's) compliance with a pre-programmed treatment schedule. The dispenser instructs the user through visual and audio cues, such as the illumination of individual medication cups that are arrayed in accordance with a daily and weekly schedule in separate orifices within the dispenser body. The system and method monitors compliance by determining when an indicated cup is (a) placed into, (b) removed from and/or (c) replaced into the correct orifice based upon the provided indication. The cups can be refilled at an appropriate time based upon an indication by the system, and/or can be provided in a removable refillable tray (that is prefilled by a pharmacist). This simplifies the refill process. The dispenser can include an on-board processor and associated data memory that stores a current configuration including the treatment schedule. The configuration can be programmed/re-programmed, and compliance can be monitored, via a wired or wireless server connection that communicates with interested parties (e.g., the user, family, caregivers, physicians and the like), and that supports a graphical user (web-based) interface. The server allows interested parties to generate reports regarding compliance. The server also transmits alerts to interested parties via a variety of communications mechanisms (telephone, e-mail, text-messaging, etc.) in cases of current or continuing non-compliance by the user/patient.

In an illustrative embodiment, the medication dispensing system and method provides a dispenser body having a top housing having a plurality of orifices each constructed and arranged to respectively receive each of a plurality of cups, sized and arranged to store medication therein, and a sensor at each of the orifices that detects when a respective one of the cups is accessed. Such access can include (a) opening or closing (or other lid-movement from one predetermined orientation to another predetermined orientation) a movable compartment lid overlying a respective cup, (b) using a presence sensor (capacitive, heat, radar, etc.) to detect a user's finger in proximity to a cup, and/or (c) at least one of placing into, removing therefrom or replacing a cup into a respective orifice within the body. A processor monitors access of each of the cups, correlates the monitored state of at least one of placement, removal and replacement of each of the cups (or otherwise placing or removing of medication in the respective cup) with a pre-programmed schedule, and provides, in response to the correlation, a signal indicative of the monitored state relative to a pre-programmed schedule. The signal to the user can be at least one of an operation of a light, transmission of a sound, generation of a cue, or transmission of predetermined information with respect to the monitored state to a server. The orifices can be arranged with respect to days and times of day. The cups can be translucent to guide light therethrough, and the cups can be selectively covered by a translucent, moveable cup lid. An illuminated reminder indicator responsive to the signal can include a plurality of lights in which each of the lights is located with respect to each of the plurality of cups. Where the cup and cup lid are translucent, an illuminated reminder indicator responsive to the signal can be located beneath or around the cup so as to transmit light into and through the cup. The moveable translucent lid can also be constructed so as to transmit light into and through the lid. The processor can be housed in the body and can be operatively connected, either wired or wirelessly, to a server constructed and arranged to enable programming and reprogramming of the configuration. The processor can monitor the user's removal of discrete cups by the user and generate compliance data by determining the user's access of each of the cups (for example, by opening or closing a compartment lid, presence-sensing, or placing, removing or replacing) at scheduled times according to a predetermined medication schedule and reports the compliance data to a server for access by an interested party. The body can also include a hinged bezel door that selectively covers each of the cups and wherein the server is constructed and arranged to report to a designated recipient information related to the opening and closing of the bezel door. The server is constructed and arranged to report to the recipient information related to at least one of (a) removal of each of the cups with respect to the configuration, (b) replacement of each of the cups with respect to the configuration, (c) refilling of a plurality of the cups with respect to the configuration, (d) replacement of an entire tray with respect to the configuration—where such a refill tray is provided in an embodiment. Moreover, the processor can be constructed and arranged to operate in accordance with a recent programmed configuration upon a disconnection from the server. Additionally, the processor can monitor the removal and replacement of the each of the cups so as to determine a requirement for refill of medication into the cups, and generates a refill reminder signal.

According to a further embodiment, a system and method of refilling a medication dispensing system includes providing a plurality of cups that are sized and arranged to store medication therein, and loading medication into each of the cups according to a predetermined medication schedule, loading the cups into a body of the medication dispensing system, wherein the body includes a plurality of orifices that each respectively receive each of the medication cups and senses removal or return of the respective cups. Illustratively, the step of refilling the medication dispensing system can include (a) providing a refillable tray, (b) loading medication into the cups, the cups being mounted into the refillable tray according to a predetermined medication schedule, (c) providing the tray filled with the medication to the user for installation into the body of the medication dispensing system, and (d) loading the refillable tray into the body of the medication dispensing system, in a predetermined alignment with respect to the body of the dispensing system. The step of providing the tray filled with the medication to the user can include opening a hinged bezel door of the body, applying a removable cover that maintains the cups with the tray and the medication within each of the respective cups during storage and handling of the tray, and closing the bezel door to secure the cups within the body. Illustratively, the processor monitors the user's removal of discrete cups by the user and generates compliance data by determining the user's removal of each of the cups at scheduled times according to a predetermined medication schedule and reports the compliance data to a server for access by an interested party. Illustratively, the processor monitors the access of each of the cups including opening or closing a lid and/or at least one of the placement, removal and replacement of the each of the cups so as to determine a requirement for refill of medication into the cups, and generates a refill reminder signal.

The illustrative pillbox can also include an additional sensor (or sensors) to detect when a pre-filled refillable tray has been placed into the pillbox body. The sensor(s) can be an electromechanical, magnetic and/or a solid state electronic sensor in various embodiments.

Illustratively, medical alert systems can be linked to the telecommunications link within the medication dispensing system and function either by direct contact by the user or by relaying a signal issued through a wireless link to/from an alert device worn or carried on the person of the user. This linkage can reduce the overall number of telecommunications devices required and the subscription service fees can be conveniently combined. In another embodiment, the communication system can provide for two-way communication using audio and/or visual information transferred between the user and an exemplary alert service provider. This communication can help to determine the nature of injuries and/or health conditions of concern, if any, and the urgency of the situation.

In various embodiments, the medication dispenser can illustratively provide audible, visual and other forms of cues/alerts, including an alert comprising a pre-recorded personalized audible and/or visual reminder. When the time for the predetermined alert arrives, the pre-recorded prompting reminder to take the dose is given by the pillbox in a friendly (or otherwise familiar) voice. By way of example, the alert can be in the form of a cute little grand-daughter advising the user, "Grandpa, time to take your pills." In addition, the return of the medication cup to the dispensing system can then prompt a gratification (or feedback) message; for example, the same little grand-daughter now saying, "Thank you for taking your medicine, Grandpa. I love you!"

The alert and gratification messages can be recorded by either recording the message into the microphone/speaker located on the local pillbox, or by using the server in which the message is either stored locally thereon in the pillbox data memory under control of the processor, or the message information can be stored remotely in the server (or both). This can be facilitated by a telephonic/network link into the server, or by accessing a recording function in the server—for example using a local computer (e.g. a personal computer (PC)) having a microphone an/or webcam functionality. This provides for a grandchild or other significant friend or relative to log into the server from a home computer, record and alert and gratification messages that are then either transmitted to the medication dispensing system at each alert time, or that are transmitted and stored within the memory of the medication dispensing system. This provides as well for a remote updating function for revising messages or substituting the current significant friend or relative with another. In an alternate embodiment, the voice message (for example, the above-described gratification, reminder and alert messages) can be accomplished via a text message and a speech-producing software application that converts the text message into the spoken word. This application can be provided in the server or in the personal communications device. Conversely, an application can be provided to convert the user's spoken word into a text or written message for transmission by commercially-available messaging protocols. These text to spoken word and spoken word to text applications can be provided from commercial sources and integrated with the operating system of the pillbox and/or server and include, but are not limited to, SMS (Short Message Service)-based protocols.

In a further embodiment, the medication dispensing system is provided with a visual display. It is contemplated that the alert and gratification messages can be visually recorded using a webcam, cellular phone, or similar audio/visual interface device. This message can then appear on the display of the medication dispensing system and serve to reinforce the illuminated dosage alert.

Desirably, the recent miniaturization of visual displays utilizing liquid crystal display (LCD) and similar/equivalent technologies provides that the medication dispensing system can have a fold-out visual display or a visual display that is built into one or more of the surfaces of its body. The cover has a visual display that can function when the lid is closed or raised. The screen can be used to display a single image or to stream a series of images. The image can be interrupted at the alert time to visually display a reminder. In an embodiment, the screen can be interfaced with a media source and used to stream media output, such as streaming web program, or a digital interface utilizing a touch screen, as will be more fully set forth below. In an embodiment, the display can present active visual alerts for hearing impaired users (for example, streaming the words "TIME TO TAKE YOUR MEDS"). In a further embodiment, the visual display can be sited on the inside of a cover on the medication dispenser system. The geometry and construction of the display is highly variable in various embodiments. The screen can be rigid or can incorporate flexible screen technology—for example a roll-up display.

In an embodiment, the medication dispenser system is provided with an openable/closable cover, and is placed in a mount that places the medication tray at an angle relative to a table top. This angled arrangement allows the medication dispenser system to appear less medical and more of a design feature within the user's personal environment. The cover can include a screen that can be used to display a single image, stream a series of images or serve as a digital and/or media interface.

As set forth above, a display can be an interactive digital display that utilizes a touch screen mounted on the medication dispenser system. The interactive screen allows a user to interact with the server, request information, report on status and receive reminders of medical appointments and similar information. For example, a user can use the touch screen to call up the medication schedule, or inquire about drug interactions and side effects. The display can have a generic interface screen when engaged by a touch (or by motion detection using the camera in conjunction with conventional software techniques), and a screen saver image when not engaged.

The display can be mounted on a sloped box having a sliding side compartment, according to an alternate embodiment.

The illustrative medication dispenser system as described above can be interactive, feature pre-recorded messages and have an interactive touch screen. In a further alternate embodiment, a media camera can be mounted so as to record the administration of medication. In this embodiment, the camera is activated at the time of the alert reminder to take the medication to record the administration of the medication that produces a clip that can be accessed and viewed later to confirm compliance with the therapy regime and potential complications. This also provides remote monitoring by a healthcare professional if desired. The visual display can be fitted with a built-in media camera for two-way communication using a web-based communication system, such as a voice-over-Internet Protocol system (for example, SKYPE® or its equivalent service). This allows interaction between the user and a remote healthcare professional (or other interested party) for feedback, therapy questions or messaging. This two-way communication can also be integrated to work with an on-board medic alert system, as described above. The two-way communication system can be arranged so that the communication does not require routing through the server and provide direct links. A telephone number or other address/identifier can be dialed directly through the medication dispenser and a built-in microphone and speakers provide the mechanisms for the two-way communication. In this manner a user is provided with the ability to directly speak with and hear from a service provider or other interested party. More generally, the system can include messaging functions that provide a variety of scheduled and unscheduled information in voice, text, pictorial and/or media form. This information can be related to the scheduled administration of one or more medications, or can be a more general message, such as an appointment, life task (e.g. bedtime reminder/wakeup call, meal call, etc.), or a general information member (e.g. a commercial message). To this end, the medication dispensing system can include, operatively connected to the body, at least one of (a) a messaging system that provides at least one of audible, pictorial, textual and media messages to the user over at least one of the communication network and a third party network and (b) a communication system constructed and arranged to deliver messages from the user over at least one of the communication network and the third party network. More generally, the camera can be employed to acquire images that are used by a user or others as part of the display, or for other purposes. A USB or other data transfer device can also be provided on the housing to load and unload images and/or other data.

BRIEF DESCRIPTION OF THE DRAWINGS

The invention description below refers to the accompanying drawings, of which:

FIG. 1A shows a closed view of an illustrative embodiment in the form of a pillbox;

FIG. 1B shows an open view of the pillbox that illustrates the compartments within;

FIG. 1C illustrates the power supply options for the pillbox;

FIG. 1D is a perspective view of a pillbox with the bezel door open, and medication pills residing in some medication cups, one of which has been removed and set aside for illustration purposes;

FIG. 1E is a perspective view showing a pillbox with the bezel open, and no cups or tray in place, showing empty compartments and LEDs, as well as detection sensors, in the bottoms thereof;

FIG. 1F shows a closed view of the pillbox where the bezel door is closed, but the individual compartments are open;

FIG. 2A depicts a disposable pre-fillable medication tray as an aspect of a refill option;

FIG. 2B depicts a medication tray placed in the illustrative embodiment of the apparatus illustrated in FIG. 1B;

FIG. 3A depicts in an exploded view each component of an embodiment of a pillbox hereof, having cups for receiving medication;

FIG. 3B depicts the door detail of medication compartments;

FIG. 3C is a perspective view of a medication tray having cups equipped with a removable cover;

FIG. 5A depicts the overall workflow;

FIG. 5B depicts an illustrative embodiment of a workflow of setting up the apparatus;

FIG. 5C depicts an illustrative embodiment of the workflow of a reminder system for the apparatus;

FIG. 5D depicts an illustrative embodiment of the workflow of a refill system for the apparatus;

FIGS. 7A-7C depicts an illustrative embodiment of the managing application, wherein:

FIG. 7A depicts a schedule and preference filling interface of an illustrative embodiment of the managing application;

FIG. 7B depicts a medication management interface of an illustrative embodiment of the managing application;

FIG. 7C depicts a caregiver interface of an illustrative embodiment of the managing application;

DETAILED DESCRIPTION

Figure 1A:
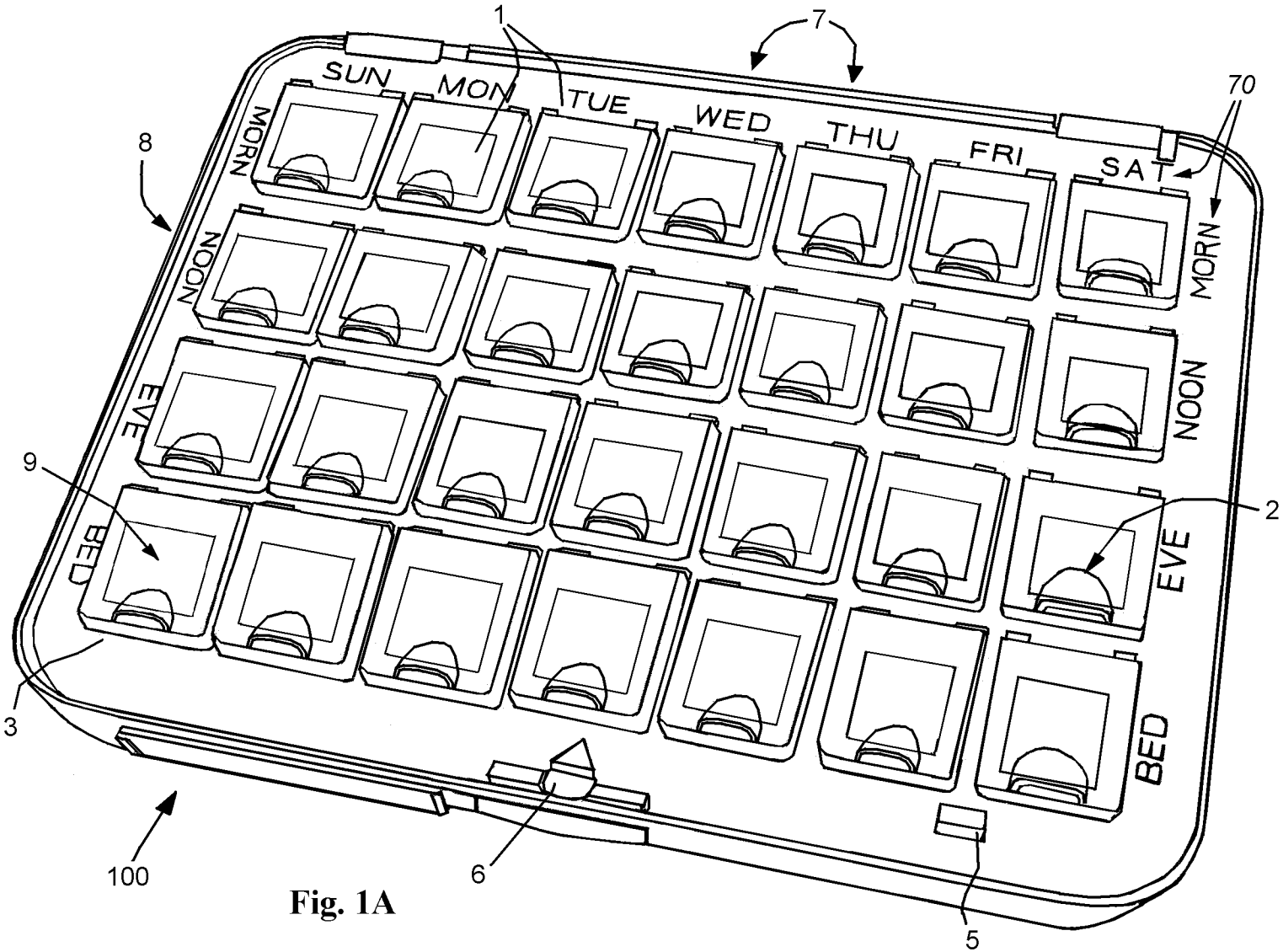
FIGS. 1A-1F show, schematically, an illustrative embodiment of a medication dispensing unit of an apparatus invention hereof. The medication dispensing unit can also be referred to herein as a "unit" or a "pillbox" where.

FIG. 1A shows a medication dispensing system 100 according to an illustrative embodiment of the invention. The medication dispensing system (also termed a "pillbox") 100 includes one or more medication "compartments" 1. The compartments 1 are set and arranged in a removable tray 15. The compartment 1 is covered by a lid 2, which is opened using the handle 3. As used herein and described more fully below, the term "compartments" refers collectively to a cup, a moveable lid covering the cup and an orifice within the body in which the cup resides. The moveable lid 2 can be furnished with a variety of movement devices, included a hinge assembly. As used herein and described more fully below, the term "orifice" refers to an individual well that is designed to hold a single removable cup. Each compartment is constructed and arranged to allow removal and replacement of the respective cup in order for a user to access the medication contained therein. The cups are designed to contain medication doses of a predetermined maximum size. The transparency or semi-transparency of the lid 2 lends to easy medication identification and visual cue viewing. The compartments can be arranged in column sets 7 and in row sets 8. The pillbox status is indicated by a status Light-emitting diode ("LED") 5. LED 5 has several status functions, including changing colors or flashing lights. Medication dose integrity and security is maintained by a latch 6 that ensures that the medication in the individual compartments 1 does not fall out. The LED 5 is placed below or around the compartments 1 so as to indicate the proximal medication. The top of the pillbox 100 is provided with indicia 70 that correlate to the column sets 7 and row sets 8. The exemplary indicia 70, as depicted in FIG. 1A, correspond to days of the week for the column sets 7 and periods of the day for the row sets 8. The indicia can alternatively be provided in other units of time, such as dates and hours.

Figure 1B:
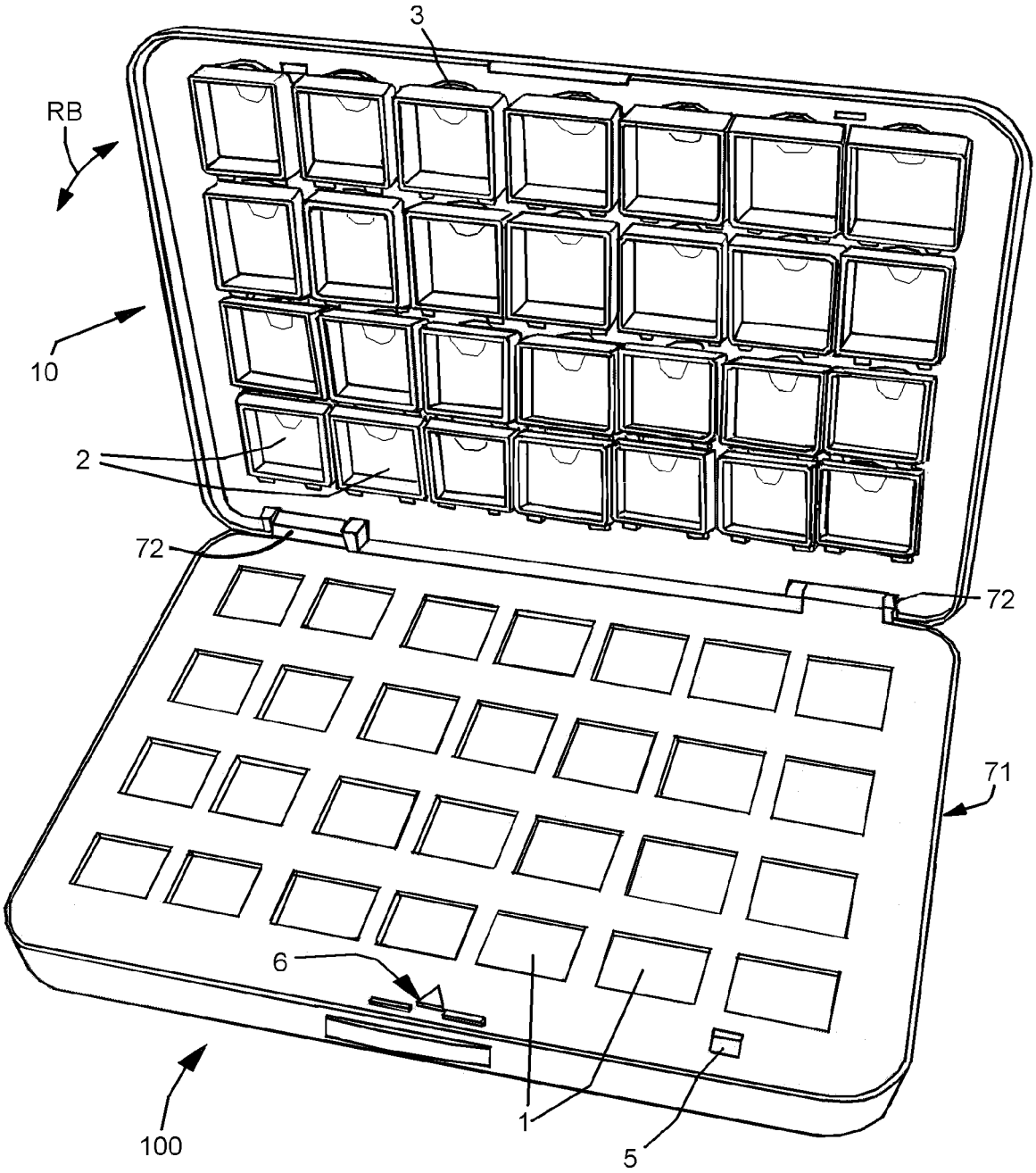

As further shown in FIG. 1B, pillbox 100 has a bezel door assembly 10 which functions as an extended protective covering for the compartments 1. The bezel door assembly 10 allows for the utilization of a removable pharmacy pack or for group treatment of the compartments, thus allowing for easy refill, as discussed below, in connection with FIG. 2B. The bezel door assembly 10 is composed of a durable, lightweight material, such as a polymer or lightweight metal and is joined with the main pillbox body 71 at hinges 72. The hinges 72 permit the bezel door assembly 10 to be rotated axially RB from a closed position, to a flattened open position. The hinges 72 have sufficient friction so as to be able to hold the bezel door assembly 10 in the perpendicular position depicted in FIG. 1B. Alternatively, the hinges 72 can be pressed or clipped to the pillbox 100, attached with removable connectors or by another mechanism that serves to allow opening of the bezel door 5 and secure attachment to the pillbox 100.

It is noted that opening and closing the bezel door assembly 10 actuates an appropriate sensor within the bezel door (not shown) that causes a report to be sent from the pillbox's central processor to the remote server (not shown in FIG. 1B, but shown and described more fully below). Each opening and closing of the bezel door assembly is a discrete event that is recorded in the server database and changes the state of the system. This feature is advantageous in directing the user to initiate a refill of the cups, either with or without the refilling of the tray 15. The detection of the movement of the bezel door assembly also advantageously provides general information about the activity of the opening and closing of the pillbox.

Figure 1C:
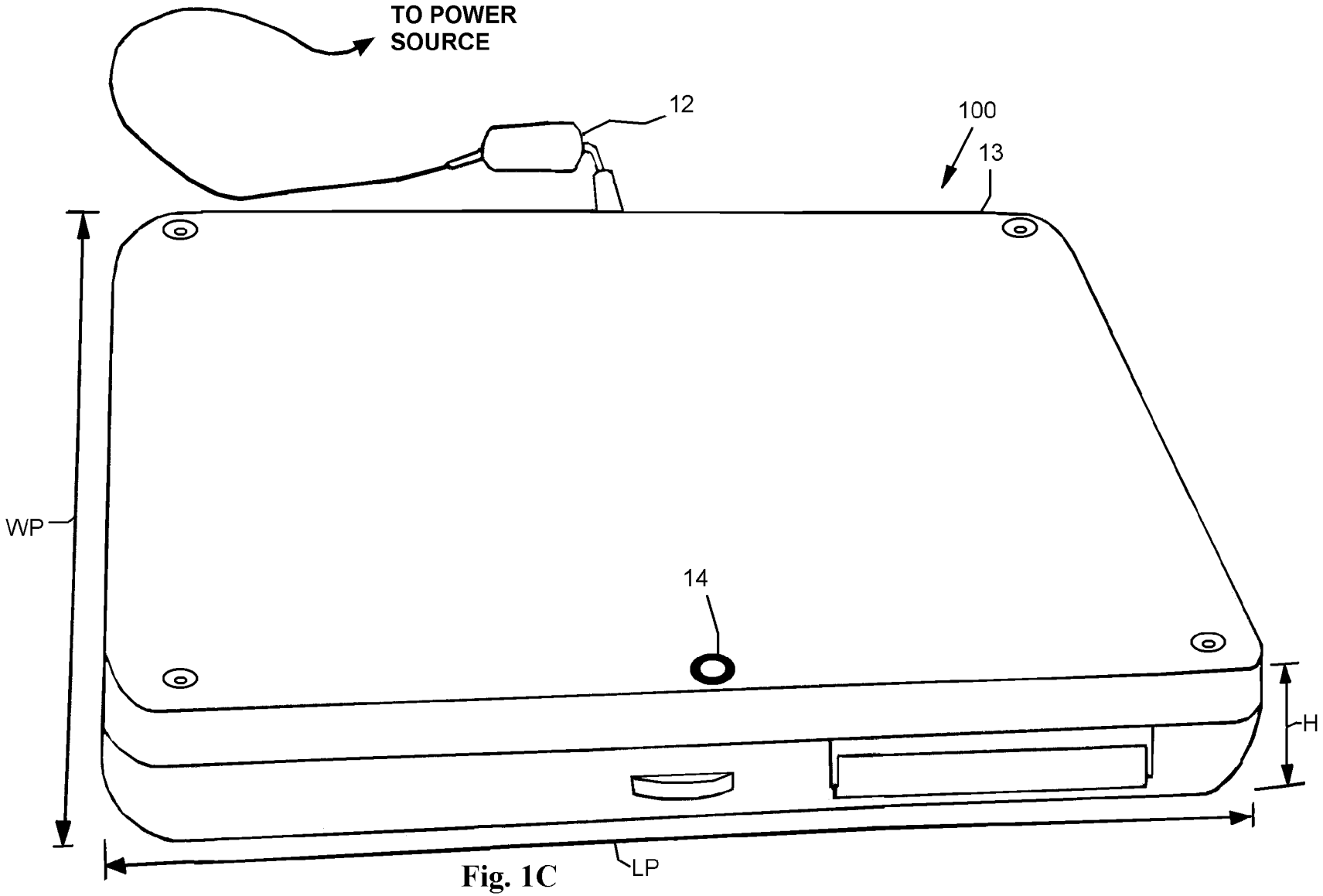

FIG. 1C shows the power options, according to an illustrative embodiment. The pillbox 100 is provided with an Alternating Current ("AC") power adapter 12 and a Direct Current ("DC") back-up battery 13 which allows the unit to function independently. The speaker 14 allows the unit to provide the user with auditory cues. The pillbox 100 contains a compact integral central processor and circuitry (not shown). The pillbox 100 is depicted in a closed configuration and has a length LP of approximately 12 to 24 inches, a height HP of approximately 1.5 to 4 inches and a width WP of approximately 6 to 12 inches.

Figure 1E:
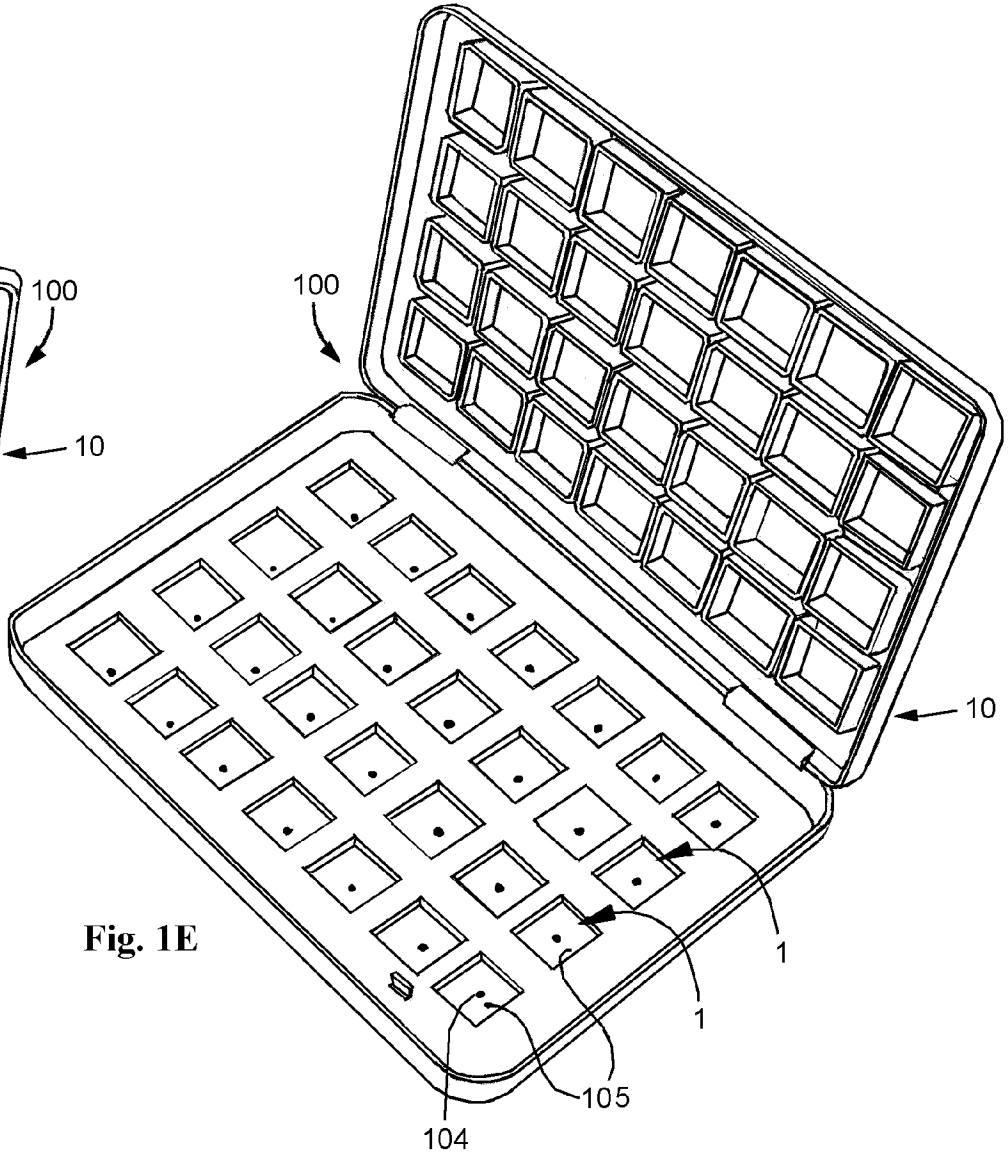
Figure 1D:
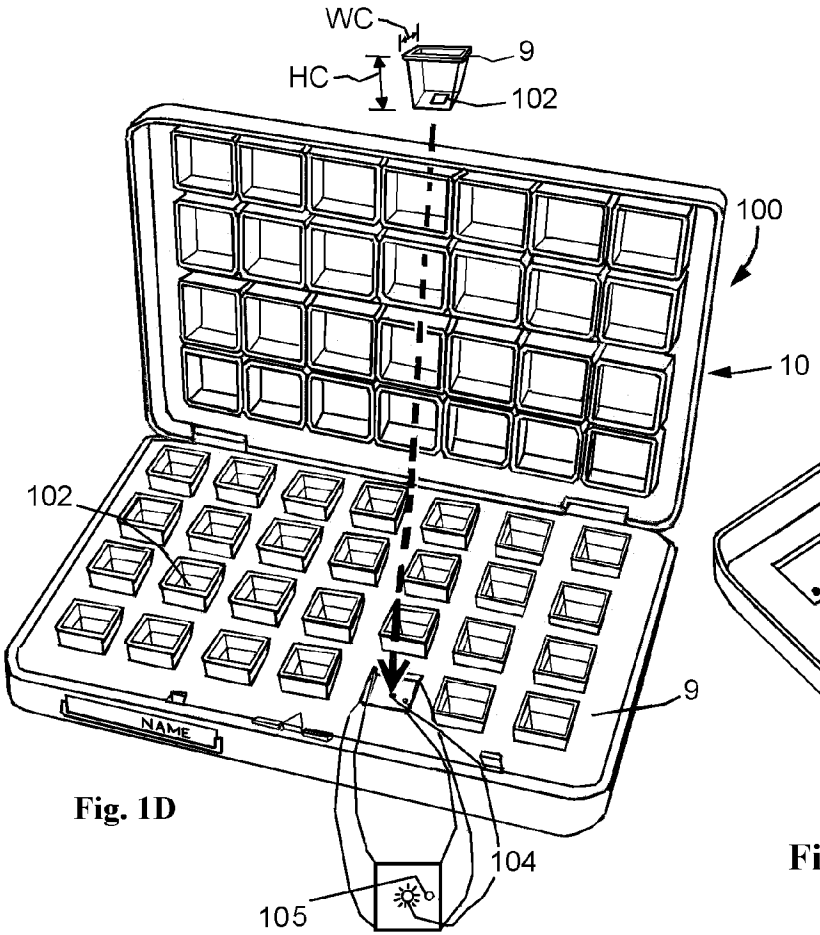

FIG. 1D shows the pillbox 100 with the bezel door assembly 10 raised to a perpendicular position. Individual medication doses are stored in cups 9. The cups 9 are easy to handle and fabricated from a durable, lightweight material. The cup can be translucent or transparent to allow for easy medication identification and visual cue viewing and also to transmit light as described further below. The cups 9 can alternatively be provided with individual lids (not shown) to allow for transportation of an individual cup. The cups, as depicted, are rectilinear. However, in an alternate embodiment herein the cups have a circular, rectangular, ovular or other desired profile. The square profile causes it to be slightly more difficult to remove the medication dose from the squared container and encourages the user to remove the cup 9 completely from the pillbox 100, which in turn generates a report on the medication event, as described more fully below. The exemplary square profile cup 9 has a height HC of approximately one and a half inches and a width WC of approximately one inch. The dimensions can be slightly greater or less, based on a need for a larger cup or for a smaller overall profile for the pillbox 100. The individual cups 9 have a small indent 102 in the bottom of each cup that bulges slightly upwards that corresponds to the position of the exemplary LED 104 within the well of orifice of the respective compartment. The LED is an illuminated reminder indicator.

As further shown in the exploded detail view of a particular orifice, the base of which engages the associated bottom of the cup includes a LED or similar light source 104 (for example, a fiber optic tip) that transmits light in one or more appropriate colors to the body of the cup 9. The translucent material of the cup acts as a light pipe that generally illuminates the cup and provides a lighted top that is visible to the user and is a visual light cue. While the LED 104 is located within the base of the orifice, in alternate embodiments, it can be provided at any other position that provides light to the cup body.

Additionally, the base of each well or orifice includes a micro switch 106 or other appropriate presence sensor (for example, an optical, pressure or conductivity sensor). The detection switch 105 (one switch being shown by way of example) detects the presence or absence of the cup based upon its weight. This presence sensor can be located at any appropriate position with respect to the orifice. The detection switch and the LED are both operatively connected to the pillbox circuitry and are part of the feedback system for maintaining the medication schedule.

FIG. 1E is a perspective view that shows the location of the LEDs 104 and detections switches 105 in the pillbox 100. The LEDs 104 under each compartment provide visual cues to the user and a communication connector which helps the unit optionally communicate with a server for monitoring purposes. Alternatively, the LEDs can be triggered to remind a patient to take an appropriate medication that is not in pill-form, e.g. injections, breathing treatments, or other medical treatments.

Figure 1F:
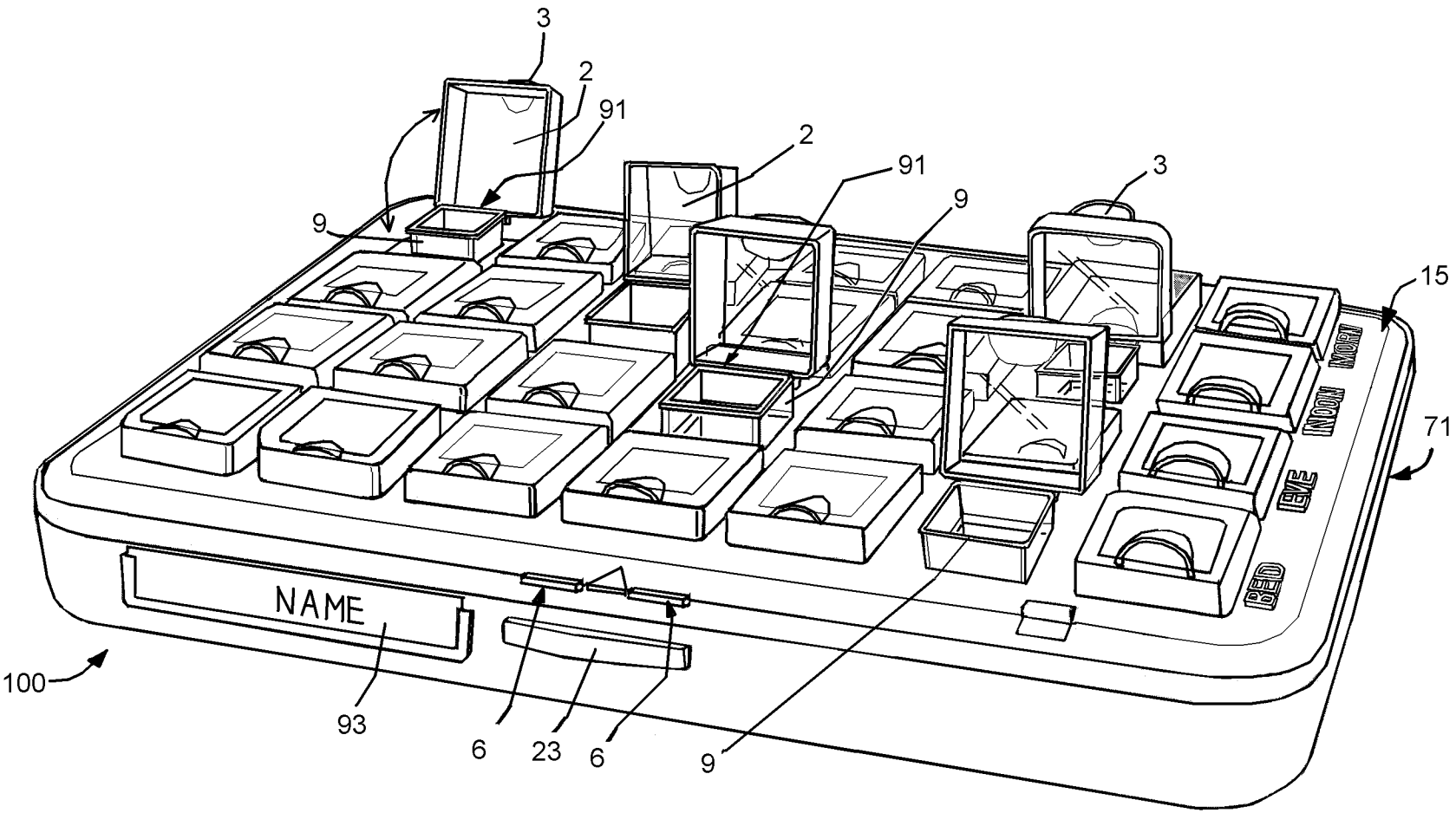

FIG. 1F is a perspective view that shows the main pillbox body 71 and the function of the compartment lids 2. The lid 2 is fabricated from a durable, lightweight material and can be transparent to allow for easy medication identification and visual cue viewing, and also to transmit light therethrough. The lid 2 is affixed to the tray 15 by operation of a hinge 91 (not shown in this figure, but more fully described below) that is pressed or clipped to the tray 71 that serves to allow opening of the lid 2 and lid and protect the medication dose within the cup 9. Each lid 2 is provided with a protruding tab handle 3 that serves to provide a catch for a fingernail, or fingernail-like object, and facilitate opening. The main pillbox body 71 is provided with a bezel button 23 that actuates the latch mechanism 6 and allows for opening when opening is needed, and secure closure when the pillbox is closed and thereby avoids accidental openings. The exemplary main pillbox body 71 is furnished with a name tag 93 that is depicted as a slotted card holder. Alternatively, the name card can be printed on a sticker or an attached LED strip or another device that establishes the identity and ownership of and by the user.

Figure 2A:
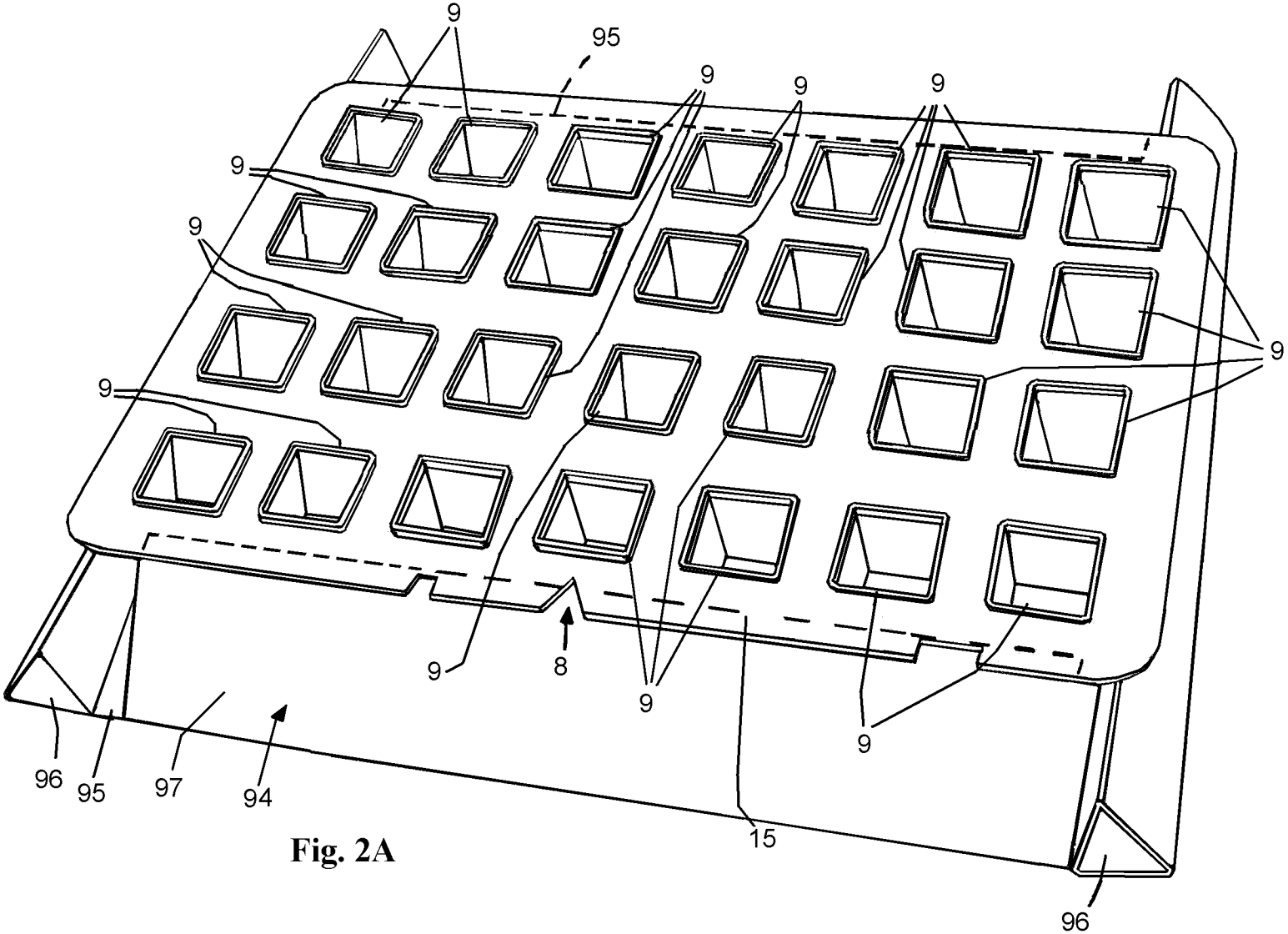
FIGS. 2A-2C depicts a medication replacement option available for the present inventions. The medication replacement option can be referred to herein as the "refill" options, where.

FIG. 2A is a perspective view of an illustrative tray 15 that is empty and ready to be refilled with medications. The tray 15 as shown has 28 compartments 1 arranged in four rows 8 and seven columns 7. The number of compartments will vary with larger and smaller pillboxes and the size requirements for doses. The tray 15 is arranged on a disposable tray holder 94. The disposable tray holder 94 is composed of cardboard or a similar disposable material that is sturdy. The disposable tray 15 can be stored on the disposable tray holder 94 with a covering (not shown) that protects the contents of the cups 9 from contamination or spoilage, such as a metal foil, plastic wrap, vacuum seal or a similar material. The disposable tray holder 94 is comprised of a bottom 95, two end supports 96 and two side supports 97. The end supports 96 and side supports 97 are fashioned in this illustrative embodiment from folding the bottom 95 so as to create a well between the ends and sides and not affect the alignment of the cups 95. Alternatively, the disposable tray holder 94 can be molded from an extruded product, or similar material, so that it has a central well that will not affect the alignment of the cups 9. The tray 15 is provided with an indicator notch 18 that serves to properly align the tray 15 when it is placed into the pillbox. The tray 15 is filled by a pharmacist or caregiver who loads the proper medication doses into the appropriate cups 9. The tray 15 is then sealed with a covering, as described above, and provides the tray 15 to the user.

Figure 2B:
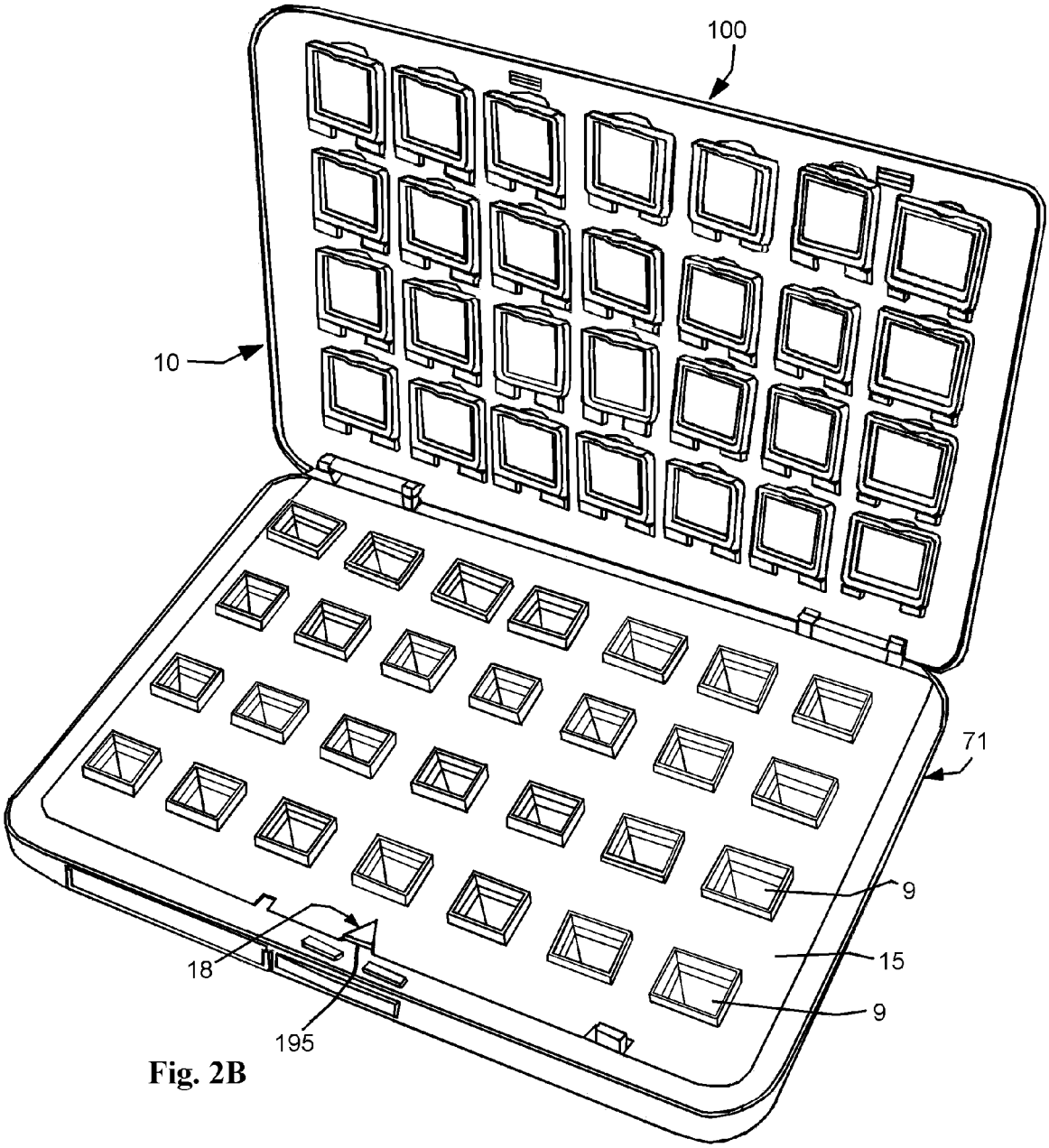

FIG. 2B is a perspective view of an illustrative pillbox 100 that has been refilled with a refillable tray 15. The bezel door assembly 10 is open. With the bezel door assembly 10 open, the tray enables easy refilling of the medication. The tray 15 is placed into the main pillbox body 71, using as an alignment reference the alignment notch 18. The notch 18 provides proper positioning of the refill tray during loading by aligning with alignment indicator 195 located on top housing 327. The tray will remain there until the next refill. Notably, and as discussed generally elsewhere herein, the cups are sized large enough to maintain a plurality of medications (e.g. pills, capsules, etc) in a single unit, thereby allowing a patient who (as is often the case) is administered multiple medications to receive all those medications at the pre-programmed time within the administration schedule from a single dosing cup. This desirably avoids confusion and any need to access multiple medication sources during administration.

Figure 2C:
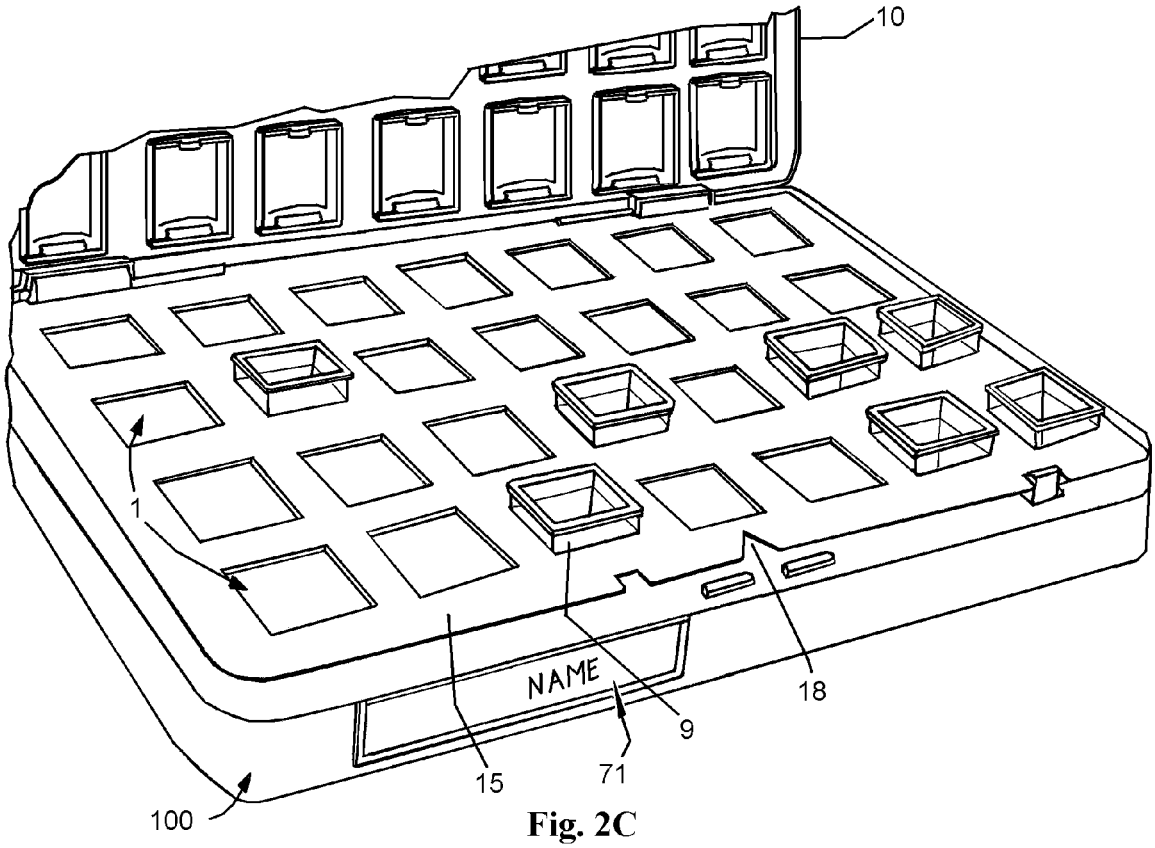

FIG. 2C is a perspective view of an illustrative pillbox 100 that contains a partially filled tray 15. The bezel door assembly 10 is open and the main pillbox body 71 is exposed. In this exemplary embodiment, the refillable tray 15 is being serviced and one particular medication is being placed into the compartments 1, according to a medication therapy regime. Most of the compartments 1 are empty and only seven compartments 1 contain cups 9. This provides for a group treatment of the medication doses by the person refilling the tray in this incremental manner.

Figure 3A:
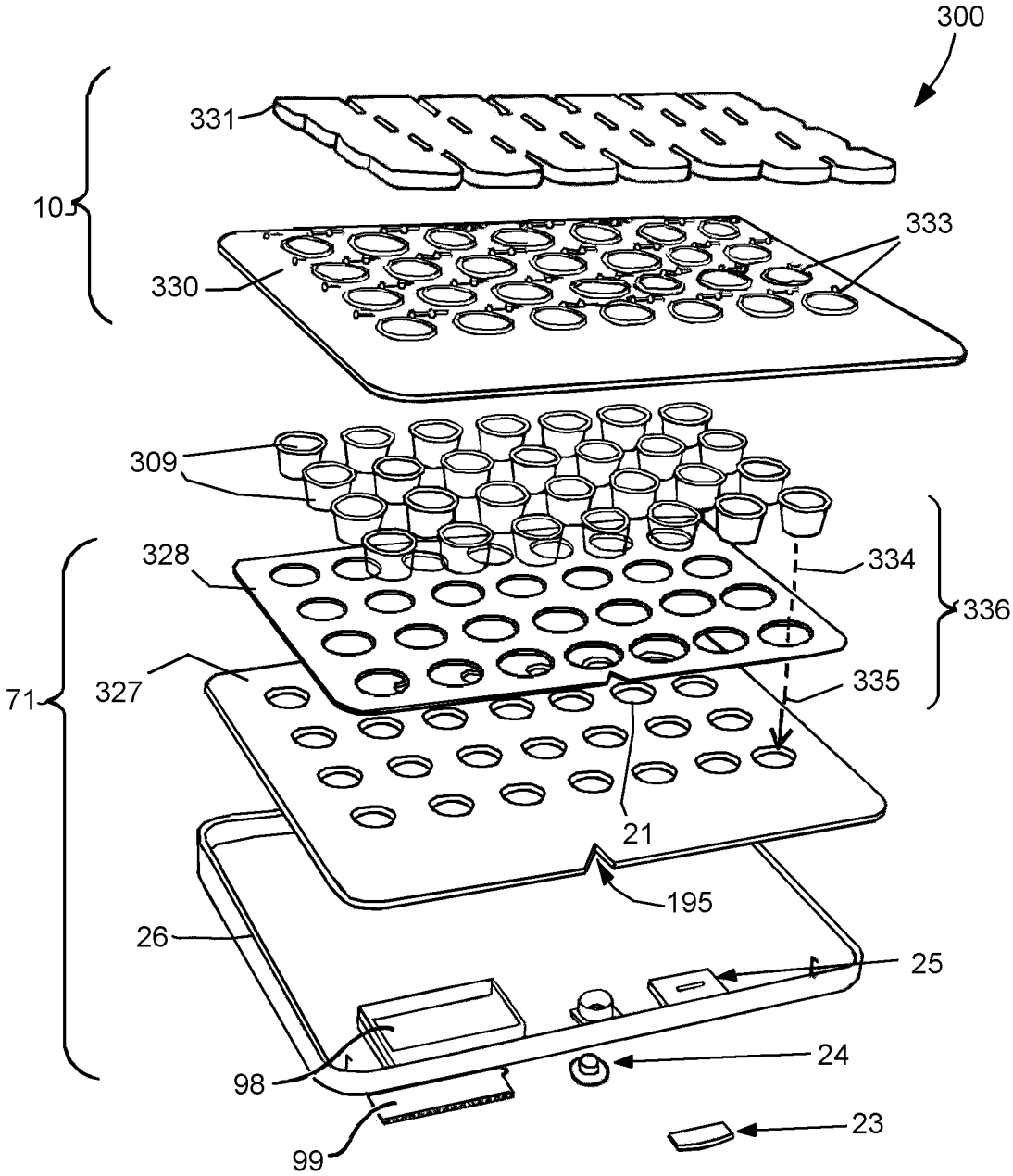
FIGS. 3A-3C depict a perspective view of each component of another illustrative embodiment of an invention hereof, where

FIG. 3A is an exploded perspective view of another illustrative pillbox 300, in which the components are separated for explanation and like parts are given like numbers. The exemplary pillbox in this embodiment utilizes cups 309. The bezel door assembly 10 consists of the bezel door 330 and clear lids 331 with latches to keep them shut. The clear lids 331 allow for easy inspection of the medication doses. The main pillbox body 71 is comprised of a bezel button 23, bezel lock 24, bottom housing 26, with integral on/off switch 25, a top housing 327, a refillable loading tray 328 with cups 333 and an orientation reference notch 21, and cups 329 that are corresponding in shape to the cups 333. Each compartment corresponds to a day/time scheduled medication dose and has medication dispensing units, cups 329 in this embodiment.

The cups 329 fit neatly into orifices 336, the orifices including holes 334 and slots 335. Holes 334 provided in a loading tray 328, which sits on top of the top housing unit 327 which has corresponding slots 335 that align with the holes 334 and receive the cups 329 via orifices 336. The loading tray 18 is analogous to the refillable pharmacy tray 15, as shown in FIG. 2A above. The top housing unit 327 fits over a bottom housing unit 26. The bottom housing unit 26 includes the integral on/off switch 25, the bezel lock 24 and the bezel button 23. The exemplary bottom housing unit 26 is equipped with a battery compartment 98 and battery compartment lid 99 for secure housing of power batteries.

Figure 3B:
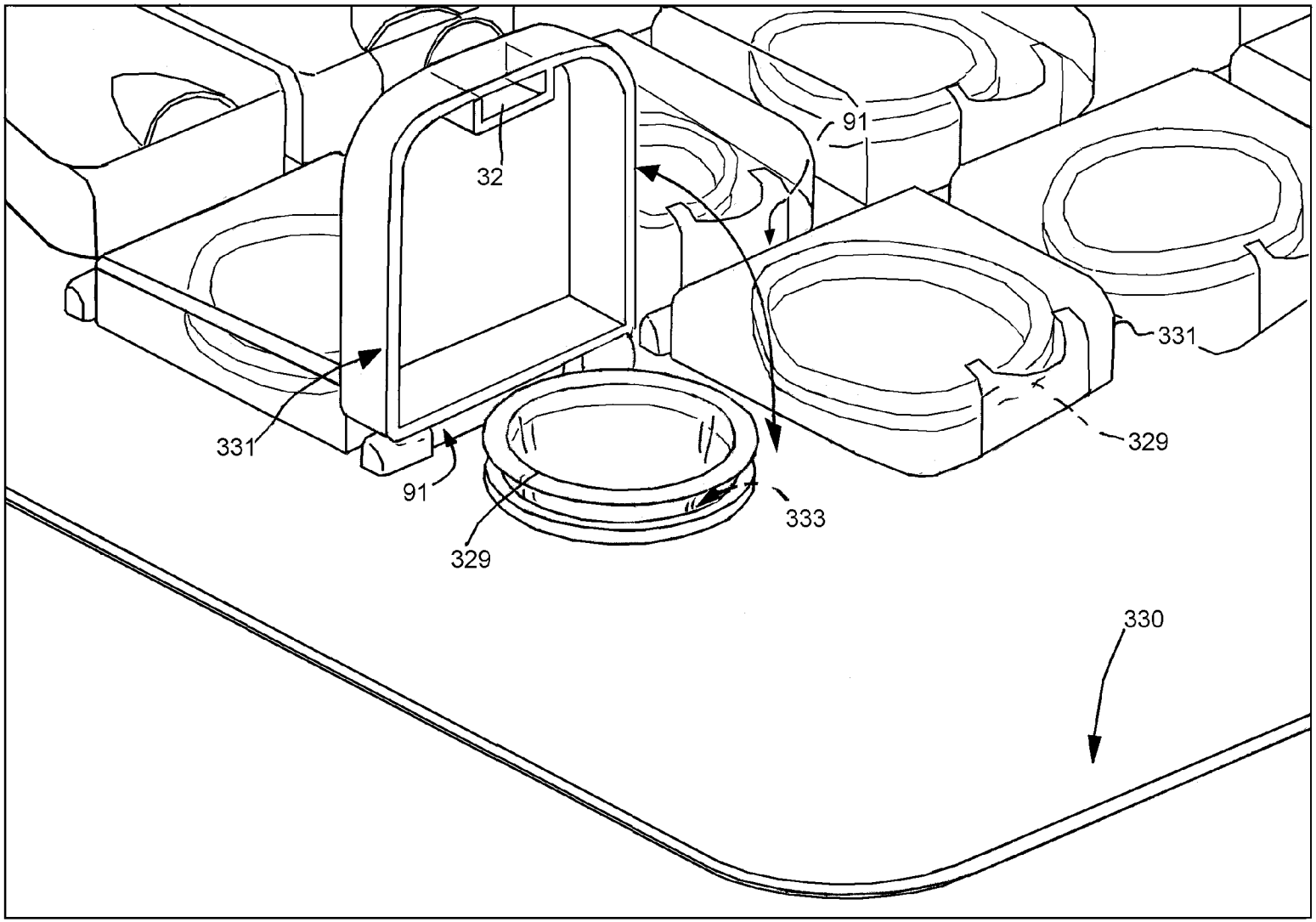

FIG. 3B is a partial perspective close-up view that illustrates the detail of a lid 131. The lid is mounted to the bezel door 330 by operation of a hinge 91. The lid 331 includes a latch mechanism 32. The latch mechanism can be a shoulder detent snap-fit type mechanism or any other such mechanism that removably secures the lids in place, e.g. a magnet. The lid 331 swings shut to cover the individual cup, in this example, a cup 329, which is set into the compartment 333. The cup 329 is raised above the top of the compartment 333 for easy removal.

Figure 3C:
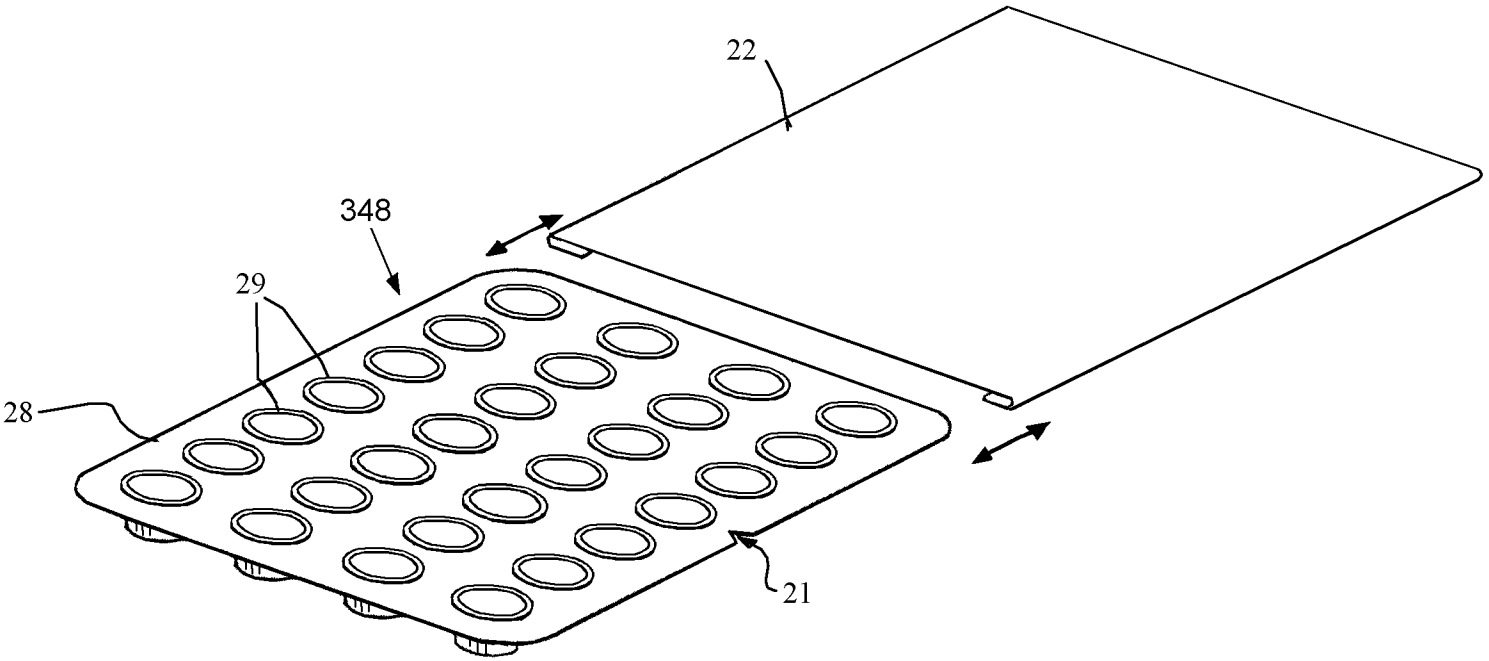

FIG. 3C is a perspective view of an exemplary refillable tray 328 having compartments, in this case, that have been filled with cups 329. A removable cover 22 is provided to ensure integrity and security for the medication doses. The exemplary removable cover slides laterally onto the tray 328. In an alternate embodiment, the cover is fashioned from a metal foil or shrink wrap that is torn off prior to use, attaches with Velcro™ or an adhesive, secures with snap clips or tabs, or some other secure mechanism that provides an impermeable protective cover over the tray 328 and its contents and prevents loss, tampering, pollution or spoilage. The locator notch 21 helps with ease of use and provides the ability to place the tray in its correct location as discussed above.

Figure 4:
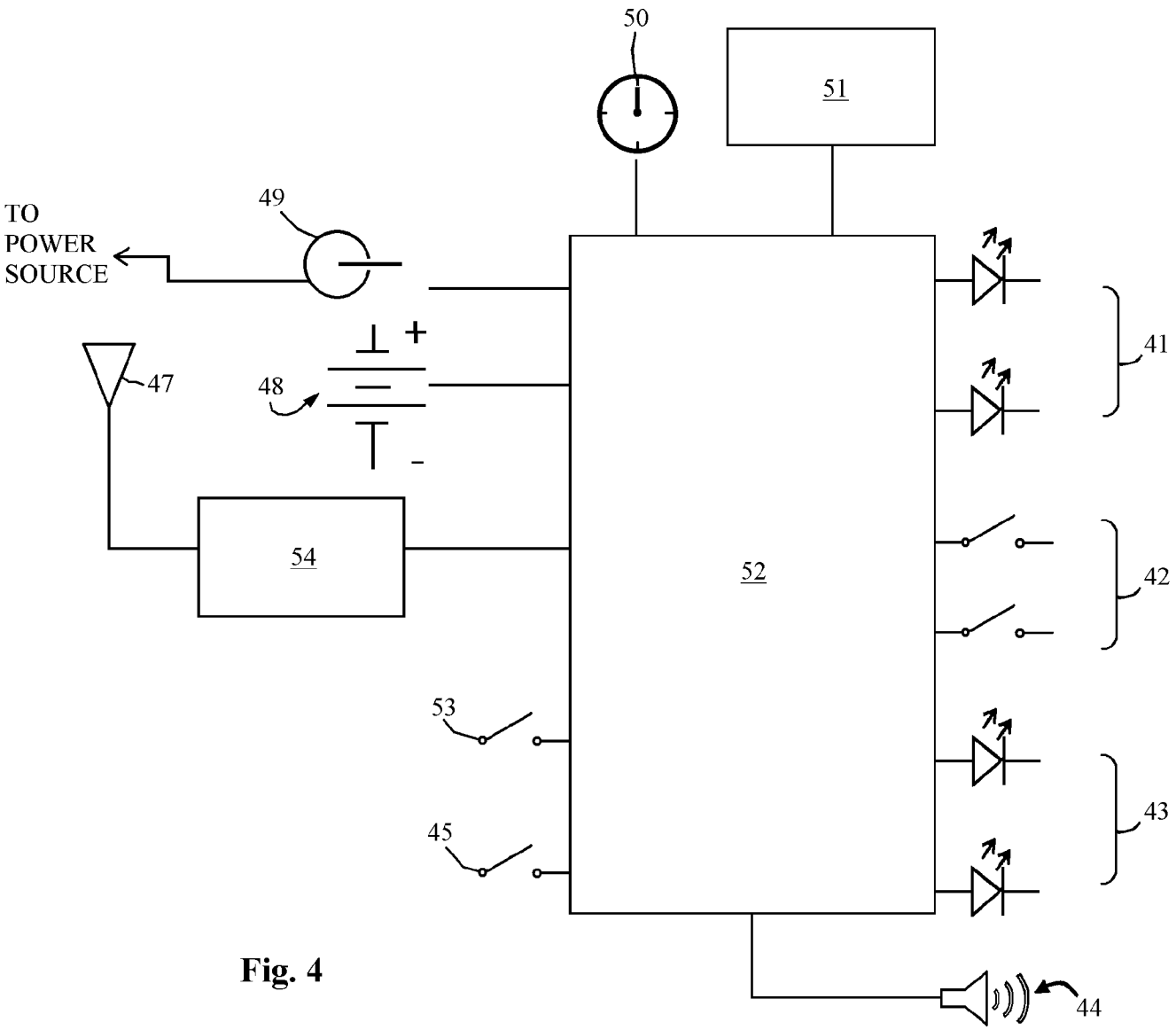
FIG. 4 is a schematic view of a block diagram of the components of an apparatus of an invention hereof, that includes a set of medication compartments, microprocessor, communications link and user interface elements such as light and sound producing components.

FIG. 4 is a schematic block diagram 400 of the interrelation of the electrical components of an exemplary pillbox. The unit functions with a microprocessor 52. Compartment LEDs 41 is integrated with the microprocessor 52 to provide visual cues. Detection switches 42 detect at least one of the placement, removal and replacement of the individual cups by operation of a micro switch, or any other appropriate device for sensing presence or weight thereupon. Removal or replacement of an individual cup triggers the compartment switch and changes the overall configuration of the system, which can be logged and recorded for data collection purposes. The tray open switch 53 detects the placement of a refillable tray. The Bezel open switch 45 detects the placement of the bezel door. There are two LEDs 43 that indicate the configuration of the unit to the end user. The speaker/buzzer 44 provides auditory alerts and cues to the user. Power to the pillbox is provided by either a battery 48 or a power supply 49, which connects to an outside power source. A real-time clock 50 enables the unit to provide timely reminders and communicate with the external central computing device. The non-volatile memory 51 stores the medication and refill schedule data as potentially provided to the pillbox when it is connected to the external computing device. Lastly, the exemplary pillbox has a communication connector 47 which aids its communication with the external central computing device through the communication link 54. In alternate embodiments, the communication is conducted utilizing Bluetooth® technology.

There need be no switches or buttons or other input devices that the user must operate to communicate that the medication has been taken. The lids of the individual compartments and/or the cups themselves serve the function of what might be served by user input buttons or switches, namely, of indicating that the compartment has been opened, from which it can be inferred that the patient has taken the medication. Thus, the device elegantly solves the problem of how the user can communicate the fact that the medication has been taken, by using elements of the structure of the pillbox itself to stand in for explicit user input devices, such as switches and buttons. This significantly simplifies actual use, and essentially allows the user to simply use the box as a storage receptacle, without even thinking about its reminder, data gathering and other functions. Thus, it is an important aspect of some inventions disclosed herein, that there need be no user input devices associated with the pill dispensing function, such as switches or buttons, and that the cups (with associated sensors), and/or compartment lids (with associated sensors), serve related user input functions.

Figure 5A:
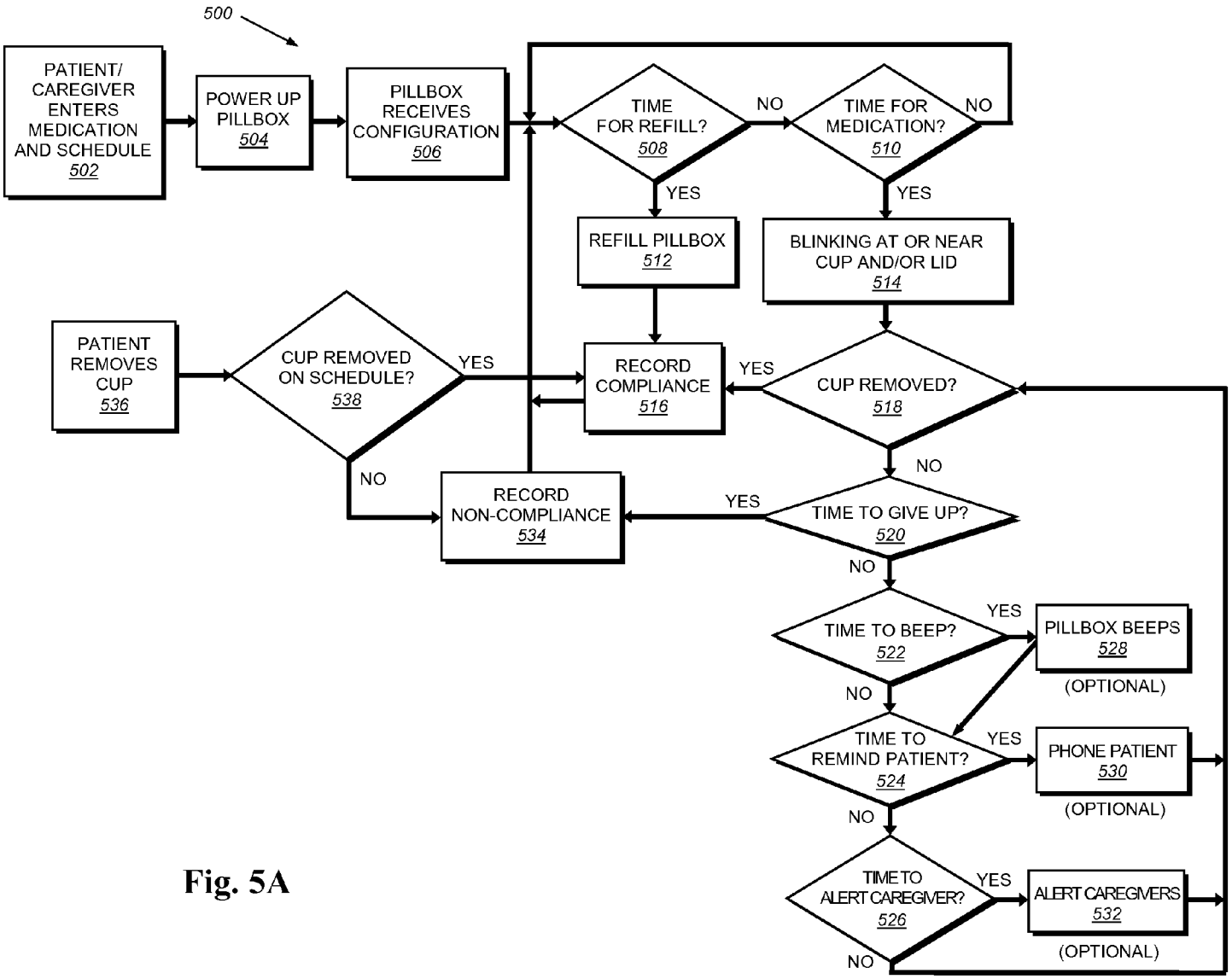
FIGS. 5A-5D depicts, schematically, in flow chart form, a series of process steps that involve an embodiment of an apparatus of an invention hereof, including steps for setting up the medication schedule that can reside on a remote computing device; actions and queries conducted by the pillbox and interactions the pillbox has with a remote computing device, where

FIG. 5A is a flow chart diagram 500 that teaches a system consisting of a number of work flows that displays the overall processes and functions of the pillbox. The process commences when the patient or caregiver enters information, or updates to information, about each medication the patient needs to take at a manager application at the central computing device 502. Updates to the information, including changes to schedules, alerts, and alert recipients can be made at the manager application and sent from the server and communicated to the pillbox via network 606, as set forth more fully below. The manager application can take the form of a web site, software application or any other database interface and can be utilized at any time to change a patient's medication profile. The data entered by the user will then be stored in a data store such as a database. For each medication, the user will need to specify the quantity and day of week and time of day that the medication needs to be taken. Further, for each medication they will have a choice of receiving auditory and/or visual cues from the unit, as well as optionally a wrong lid tone and different levels of auditory cues. The user will also need to configure valid time windows corresponding to each day set compartment for medication consumption during the day. For example they can set up a morning window from 7 AM-9 AM, a noon window from 12 AM-2 PM, and evening window from 6 PM-8 PM and a nightly window from 10 PM-12 PM. They can also set up a refill window, potentially specifying the day of week and time of day that the refill is expected to be executed. Lastly, the user is able to schedule the time at which they expect the auditory cues to begin relative to the end of the medication window or refill window, as well as the time they expect themselves or their caregivers to be alerted for non-compliance.

The pillbox is then powered up 504, initiating a configuration subroutine that will be more fully described in FIG. 5B below. The configuration information is then received by the pillbox 506. The system then queries as to need for a refill 508 and generates a reminder via the status indicator and/or via the server in the form of a prompting signal (for example, a phone call, text message, sound cue, light effect, or the like) to the user and/or caregiver, or, if selected, to the designated pharmacist. If it is, then the system will initiate a refill routine 512 and make sure that the records are compliant 516 and return to the refill query. If the refill query 508 is answered in the negative, then the system will query for medication time 510. If the answer is no, then the system will return to the question of refill timing 508. If the answer is yes, then the pillbox LED will initiate the reminder process and begin a blinking light function 514 to alert the user. The system now queries as to whether the compartment has been opened during the scheduled window 518. If the patient takes their medication during the scheduled window and the compartment has been opened, then the pillbox communicates this compliance information to the server 516. If the compartment has not been opened, then the system queries as to whether it is time to give up 520, and if yes, record the non-compliance 534 and return to the refill timeliness query. If the patient does not take their medication following the visual cues, the next set of cues is auditory—in the form of beeping, unless a different auditory cues has been selected. If it is not time to give up, then the system queries as to whether it is time to beep 522 and if yes, then beep 528, if it is set to allow audio emissions in the form of beeps. Prior to the end of the scheduled medication window, the unit communicates a message to the server to initiate a phone call to the patient to remind them to take their medication 524. If it is time to remind the patient, then the system phones the patient 530 and checks for the removal of the cup from the respective orifice 518. Lastly, at a scheduled time prior to the end of the medication window, the server will either be notified, or will itself initiate an alert to the patient's caregivers via an alerting mechanism such as email or Short Message Service Method (SMS) 526. If it is time to alert the caregivers, then the alert is given 532 and the system checks for the cup removal 518. If it is not time to alert the caregivers, then the system queries the cup removal 518. When the patient removes the cup 536, the system queries whether the cup removal is on schedule 538. Finally, if the patient does not take the medication at a pre-determined period after the medication window, the unit will alert the server and record the non-compliance event 534. If the compartment opening is on schedule, then the system records the compliance with the server 516.

Figure 5B:
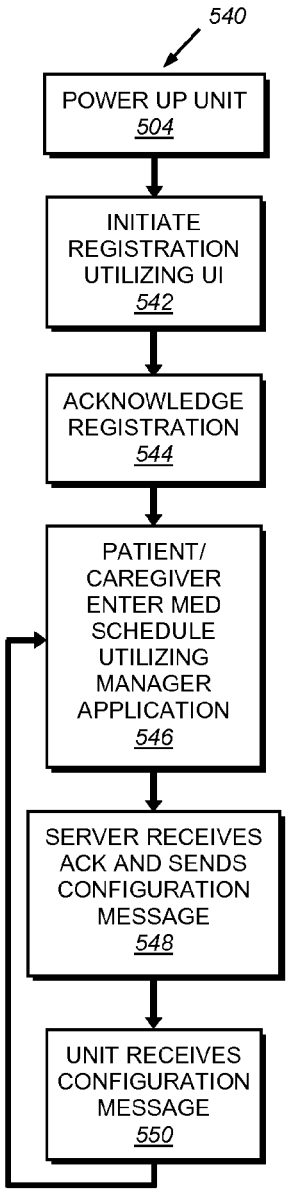

FIG. 5B illustrates the power up and configuration subroutine 540. When the pillbox unit is powered up 504, the registration process initiates at the server 542. Once this process is initiated, the registration receipt is acknowledged by the user at the pillbox 544, verifying that the communication circuit between the account at the server and the physical box has been established. The patient or caregiver then enters the medication schedule, utilizing the manager application 546. The server on receipt of the registration acknowledgment now sends the patient specific scheduling and medication data to the pillbox for use 548. As the unit receives this configuration information 550 is stores it in non-volatile memory, and is then ready to function. The server communicates with an interested party and that is interconnected via a communication link with the processor, the server being constructed and arranged to control the pre-programmed schedule by the interested party and enable monitoring by the interested party of access of cups and a status of the system.

Figure 5C:
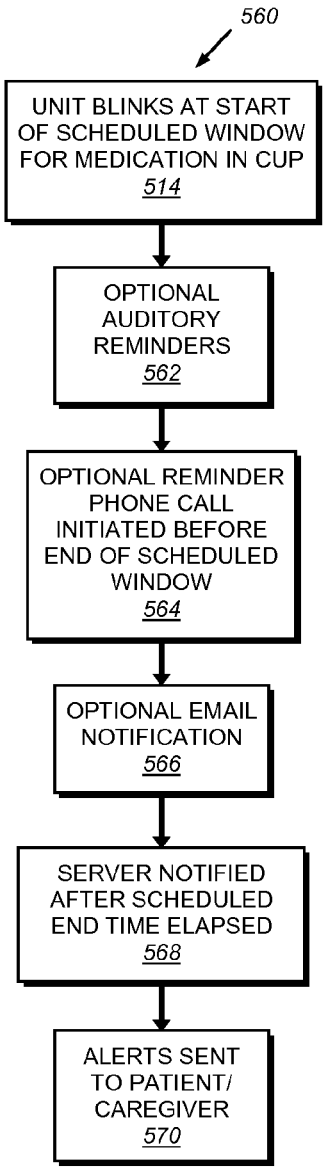

FIG. 5C is a flowchart that illustrates the reminder process 560 explained above. The pillbox unit blinks 514 at the start of the scheduled window for taking the medication dose in a particular compartment. The alert can include optional auditory reminders 562 in the form of beeps. In an alternative embodiment, sound, musical or recorded voice cues can be utilized as auditory reminders. After this, a reminder phone call can be initiated prior to the end of the scheduled medication window 564, if this option has been selected. The next reminder cue is an email notification 566 or text message. After the scheduled medication end time has passed and if the medication has not been taken, then the server is notified 568 and alerts are sent to the patient and/or patient caregivers 570.

Figure 5D:
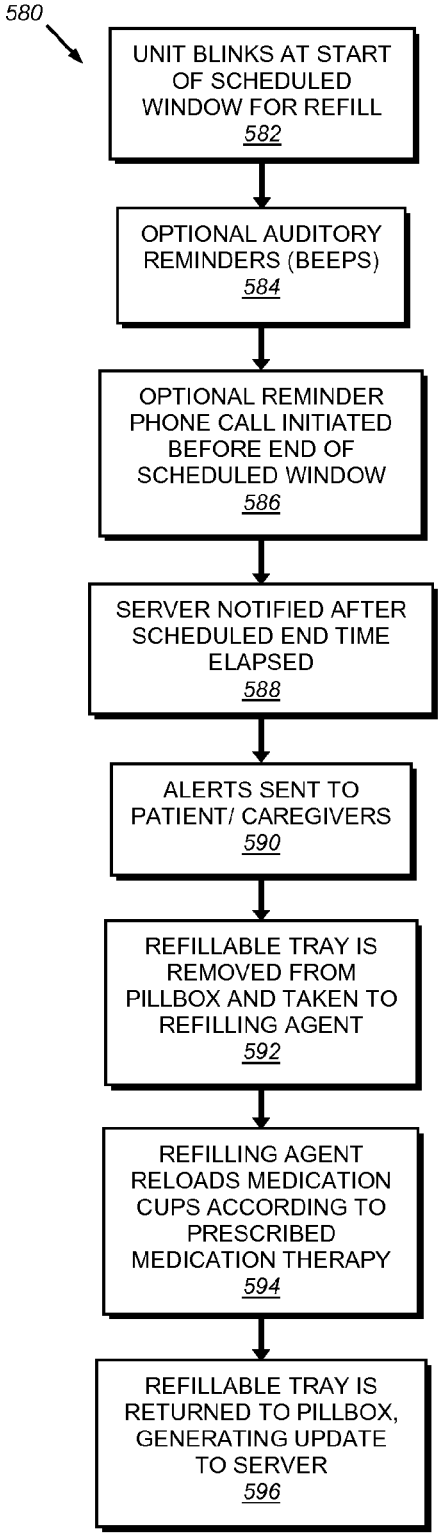

FIG. 5D is a flowchart that illustrates the refill process 580. The pillbox initiates the refill process 580 by recognizing that it is time for the refill 512. If the refill process does not start at the scheduled time, this is indicated by visual 110 and/or auditory cues 584. Following this, if the refill process has not commenced, the unit will potentially initiate a phone reminder 586 to the patient and/or caregiver. If the end time of the refill window is reached before the refill is either initiated or completed, the unit will notify the server 588, which will alert the appropriate persons via previously specified methods such an email or Short Message Service (SMS) Methods 590. The user can remove the refillable tray 15 from the pillbox 100 and can take it to a refilling agent 592, e.g. a caregiver, pharmacist, or the patient him/herself. Upon receipt of the tray, the refilling agent reloads the cups 9 in accordance with the prescribed medication therapy 594. The refillable tray 15 is returned to the pillbox 100, ensuring proper alignment by aligning notch 18 with an alignment indicator 195. At this point, the pillbox 100 generates an event report that is sent to the server or stored in the nonvolatile memory for upload to the server at a later time.

Figure 6:
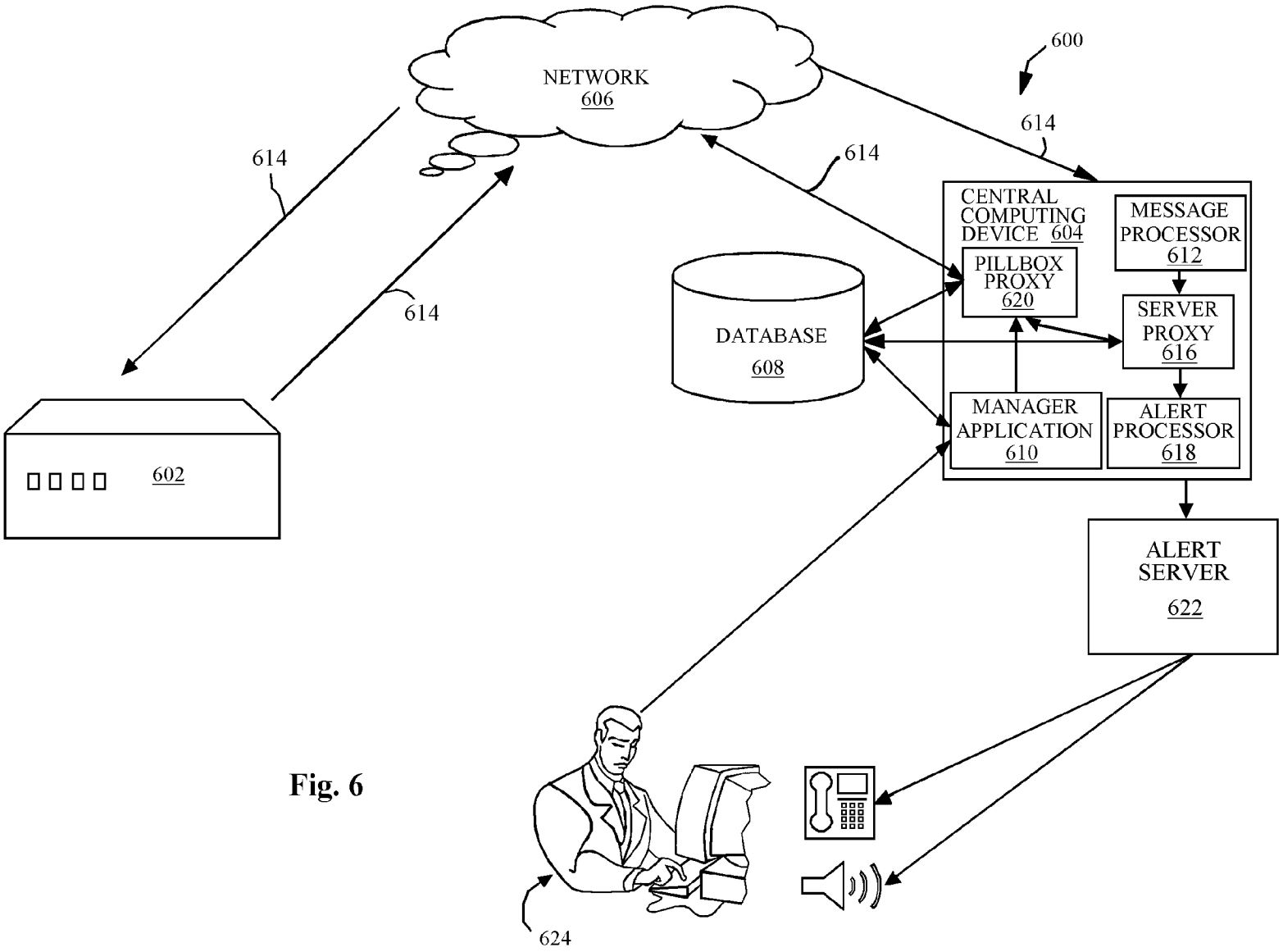
FIG. 6 depicts schematically a block diagram of the various components of an exemplary embodiment of the system described herein. This diagram illustrates the overall system architecture and interactive nature.

FIG. 6 is a block diagram that illustrates the system architecture of the entire system 600. An exemplary pillbox 602 and an illustrative central computing device 604 are linked together via a network 606. Pillbox 602 automatically links to network 606, without the need for user interaction. However, in the event of a connection interruption between the pillbox 602 and the network 606, the pillbox can operate autonomously according to the patient specific scheduling and medication data that is stored in the pillbox's non-volatile memory. Upon reconnection, the compliance data gathered during the downtime is automatically uploaded to the central computing device 604. The central computing device 604 can be a single server or a farm of computer servers. The central computing device 604 stores user, medication, schedule, pillbox data, as well as all event and compliance data, in a database 608. The data in the data store can be manipulated by a manager application 610. The software on the central computing device 604 comprises a message processor 612 which receives messages from the pillbox through a communication link 614. These messages are then passed onto software that functions as a server proxy 616 and appropriately communicates with the alert processor 618, the database 608 and the pillbox proxy 620, whose function it is to communicate with the pillbox 602 via the communication network. The alert processor 618 communicates with an alert server 622 that appropriately initiates an alert to the caregiver 624 via email, Short Message Service (SMS) Methods, phone or any other alerting mechanism.

The compliance and non-compliance data that is collected by the central database 608 is beneficial to this device. This data can then be distributed in various forms such as reports, and in varying frequency—such as real-time, daily, weekly or monthly reports in either single patient or multiple aggregated patient forms.

Figure 7A:
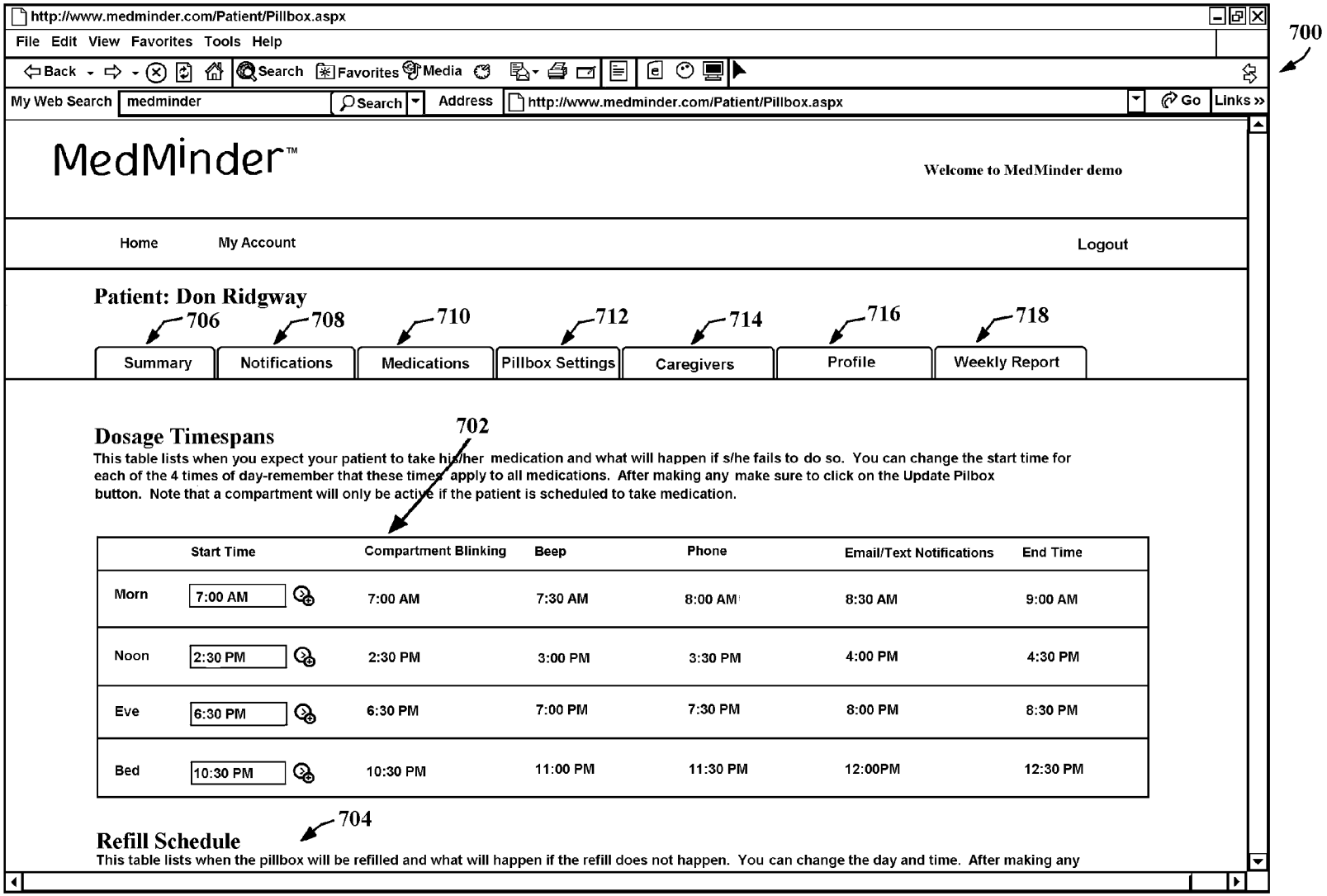

FIG. 7A shows a screenshot of a pillbox configuration interface 700 found in an illustrative embodiment of a manager application residing at the computing device. The manager application is either a desktop application or a web interface which communicates with a server at the back-end. This screen enables the user or an interested party (for example, a physician, caregiver, pharmacist, family member or other privileged party) to establish medication dosage schedules 702 which correspond to the row indicia on the pillbox unit, configure the refill schedule 704, and allows the user to customize the alerts.

The screenshot in FIG. 7A presents a variety of tabs. In this illustrative embodiment, the text presents seven functional screen tabs. The screen is currently set for the "Pillbox Settings" tab 712, and presents the dosage time span, including the medication dosage schedules 702 and refill schedule 704. The user can select to shift to one of the other tabs. These tabs remain usable on each screen. The other screen tabs include "Summary" tab 706, "Notifications" tab 708, "Medications" tab 710, "Caregivers" tab 714, "Profile" tab 716, and "Weekly Report" tab 718.

Figure 7B:
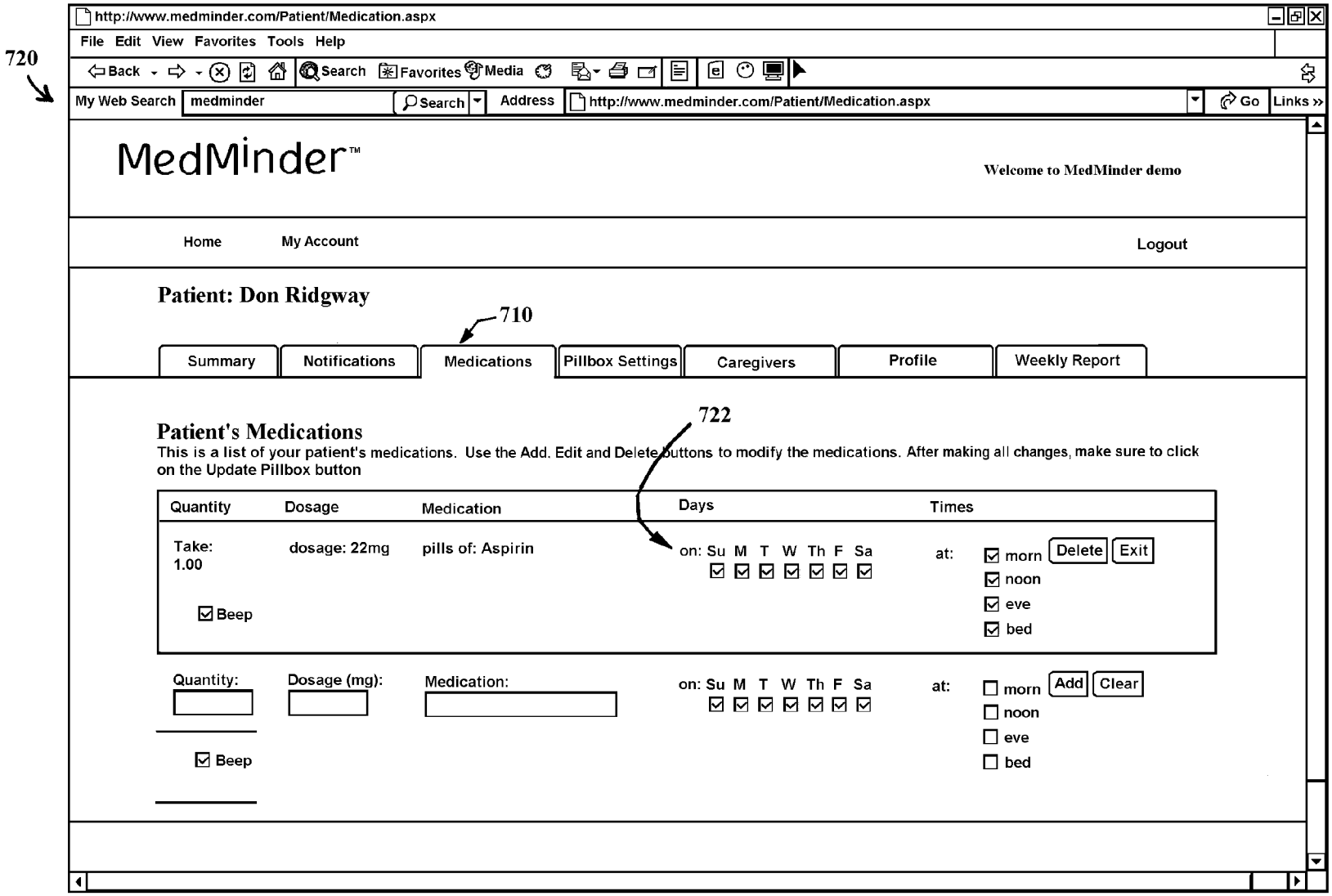

FIG. 7B shows a screenshot of a medication scheduling interface 720 found in the above embodiment. The "Medications" screen tab 710 has been selected. This screen enables the user to set up the schedule for medication 722 by date and times.

Figure 7C:
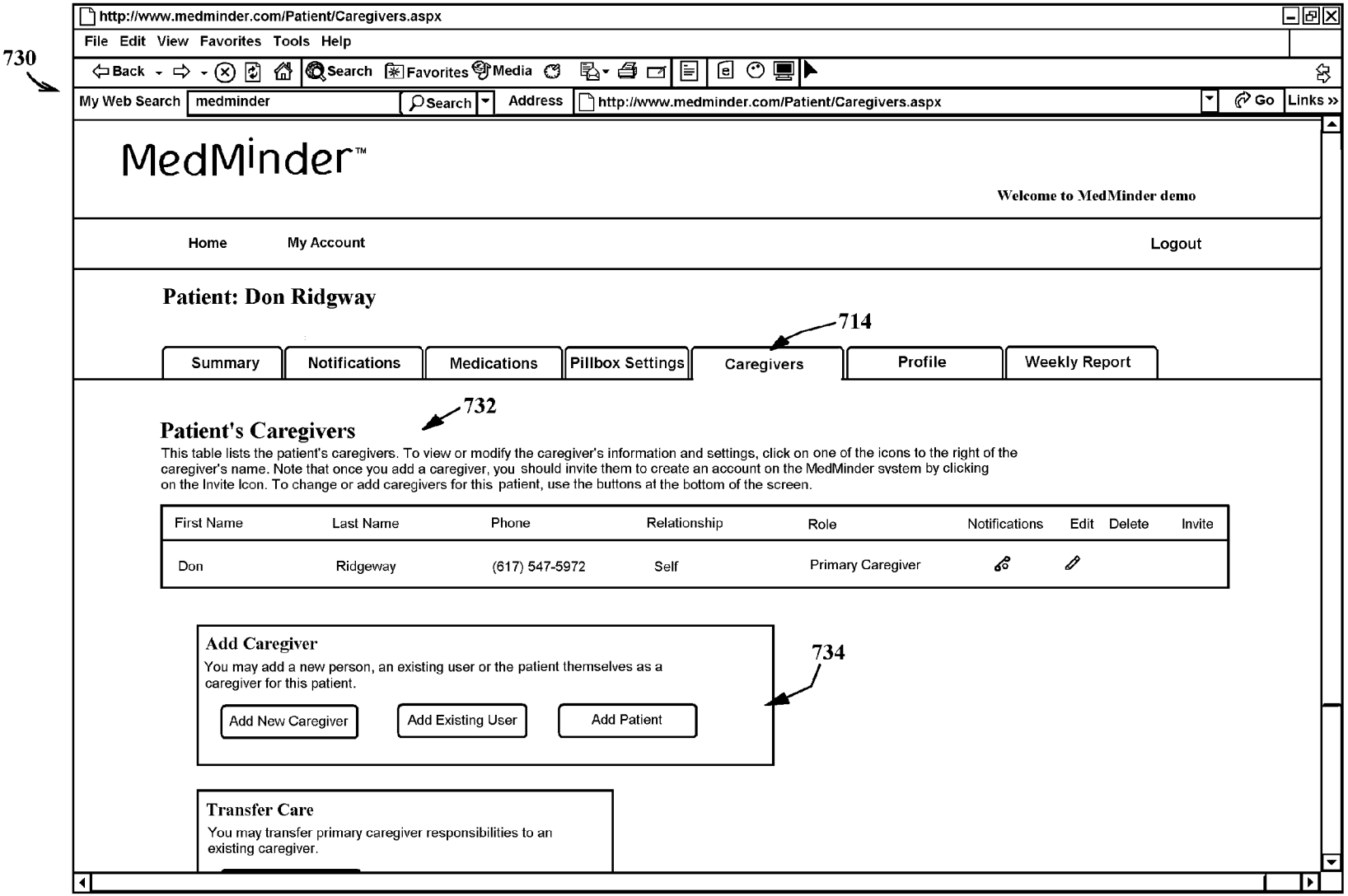

FIG. 7C shows a screenshot of a caregiver listing interface 730 found in the above embodiment. The "Caregivers" screen tab 714 has been selected. This screen enables the user to list all caregivers 732 and important contact information. This interface also permits addition of new caregivers 734.

Figure 7D:
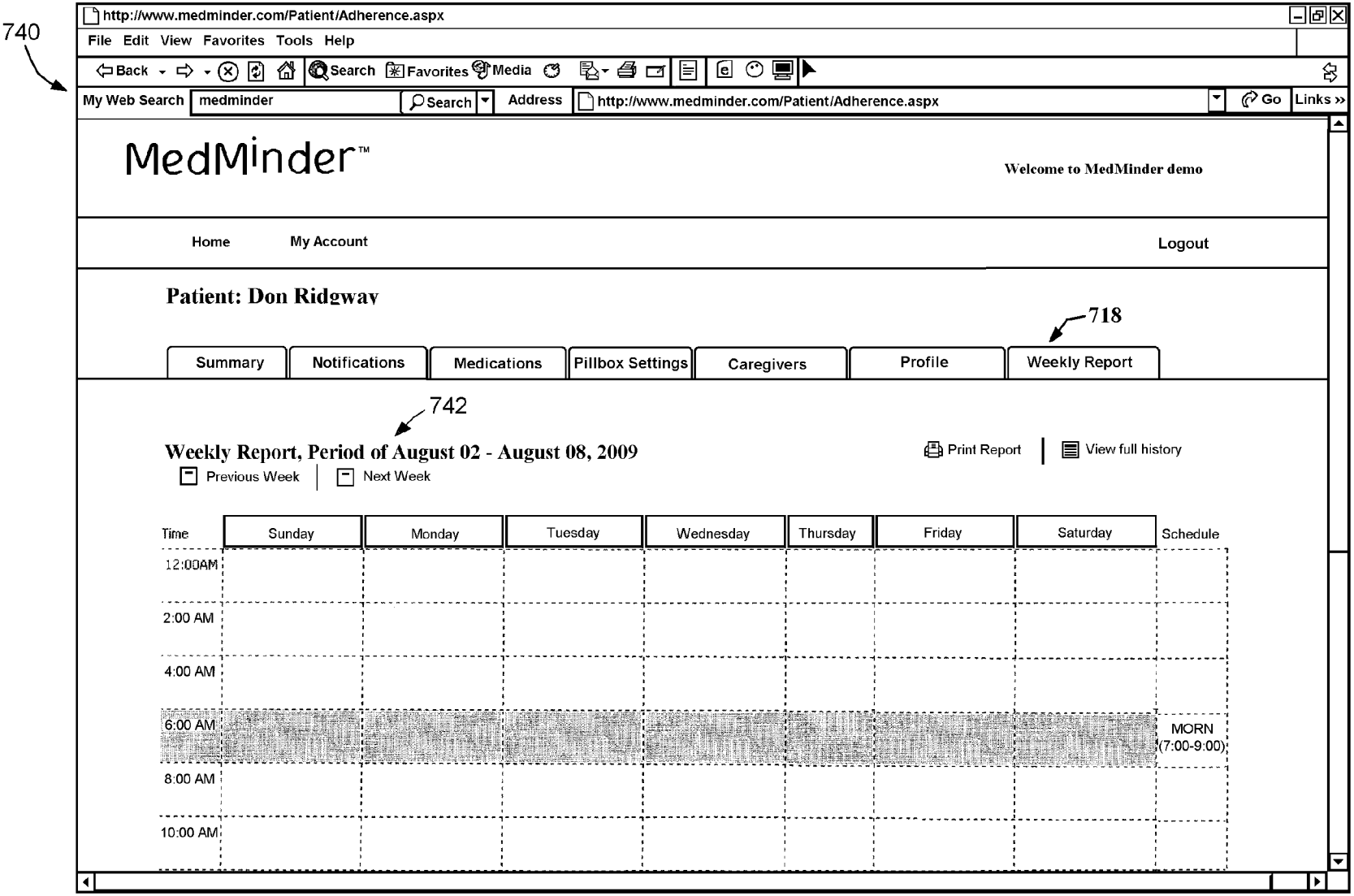
FIG. 7D depicts a weekly report filling interface of an illustrative embodiment of the managing application.

FIG. 7D shows a screenshot of a reporting interface 740 found in the above embodiment. The "Weekly Report" screen tab 718 has been selected. This screen enables the user to access information about compliance with the schedule. The schedule of compliance 742 provides a record of compliance data that is triggered by recent configuration changes at the pillbox unit. Data gathered at the central computing device can be accessed through flexible reporting capabilities on a periodic basis. In addition, this data can be exported to external systems through various methods or interfaces such as application interfaces to external systems or FTP to external computing devices.

Figure 7E:
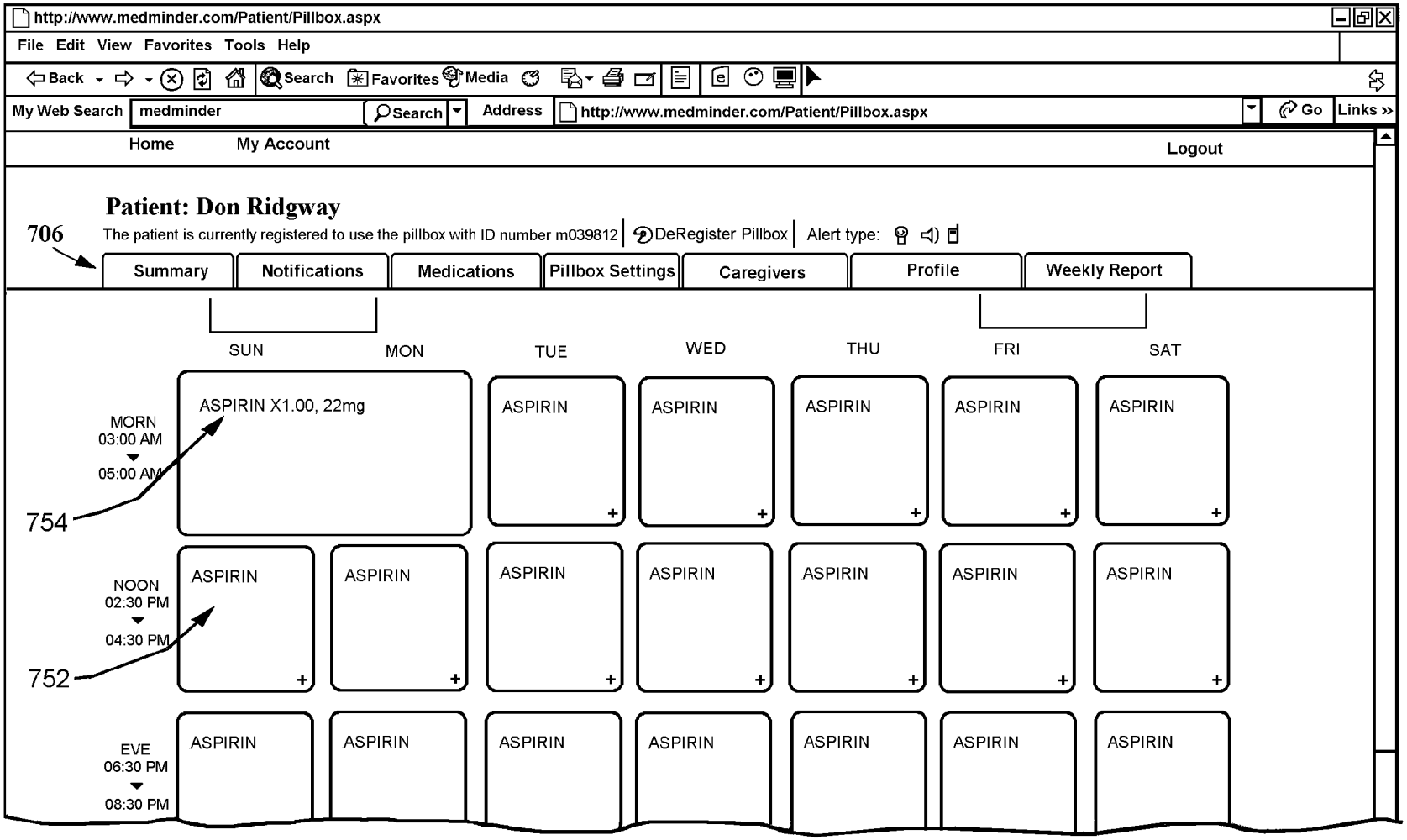
FIG. 7E depicts a compilation of medications interface of an illustrative embodiment of the managing application.

FIG. 7E shows a screenshot of a medication schedule and dose interface 750 found in the above embodiment. The "Summary" screen tab 706 has been selected. This screen presents the user with an emulative image that allows the user to virtually observe the pillbox and virtually open any of the lids 752 and review the dose and medication 754 for each scheduled dose. This screen is generated based upon the refilling agent's entry of the doses and schedule and the interactive recordation of each dosage event by the database management system.

In another embodiment, the number of compartments in the medicine dispensing unit itself can be greater or lesser. The form and shape of the cups can be round in profile, square or another shape, as required, with corresponding geometry in the compartment lids. The reminding mechanisms can alternatively vary in terms of the form of the visual and auditory cues. Vibrational cues can also be used. Similarly, alerting can occur in various alternate forms and medium. The unit can communicate with the manager application at the server via various wireless or wired mechanisms. The manager application at the server can be designed to be not only a place to schedule medication and alert, but also as an educational and social hub for caregivers and family to converge, learn about and discuss being involved in the care of the user.

Figure 8:
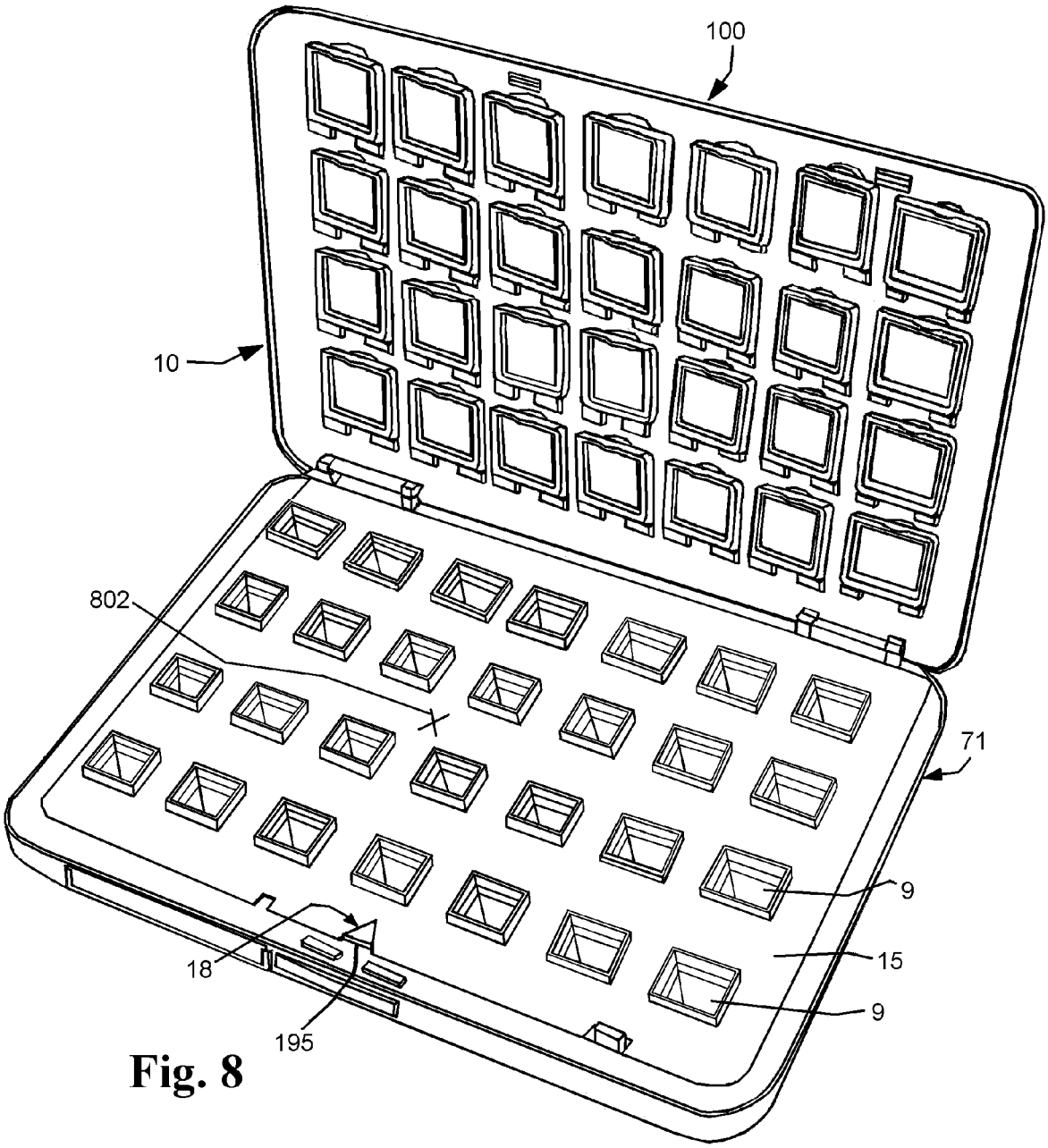
FIG. 8 depicts refillable tray sensors for a medication tray placed in the illustrative embodiment of the apparatus.

In another embodiment, the illustrative pillbox is provided with a sensor or sensors 802 that detect(s) when a pre-filled refillable tray 15 of medications has been placed into the main pillbox body 71 as shown in FIG. 8. This sensor supplements the open switch 53, which also detects the placement of a refillable tray. The refillable tray sensor 802 can be implemented using a variety of technologies including, but not limited to, electromechanical devices, magnetic or solid state electronic sensors. When the sensor 802 is activated by the placement of a refillable tray 15 into the main pillbox body 71, the placement is noted and communicated to the external computing device and the pillbox status is updated and recorded.

Commercially available communication systems encourage independent living and are provided as a subscription service. Compact communications systems provide for two-way communication between the user and a remote operator. These systems can be linked to a medical alert system provider that provides for activation by a consumer when a medical crisis arises and that transmit a signal to a provider that assistance is requested. A conventional communication system includes a wireless actuator device, a transceiver and a remote operator service. The consumer of the illustrative pillbox can also benefit from an integral communication system, resulting in a situation in which there are two tandem telecommunication systems in the household, one for the communication device and the other for the pillbox. Given that the pillbox has an integral transceiver and is in telecommunication with remote systems, a communication actuator and/or communicator can be built into the pillbox. The pillbox's communication system is constructed and arranged to route signals from the communication system via the pillbox's onboard transceiver for passing on communications to the service representative for the communication system provider. The pillbox can provide a wireless link for actuation by a remote device.

Figure 9:
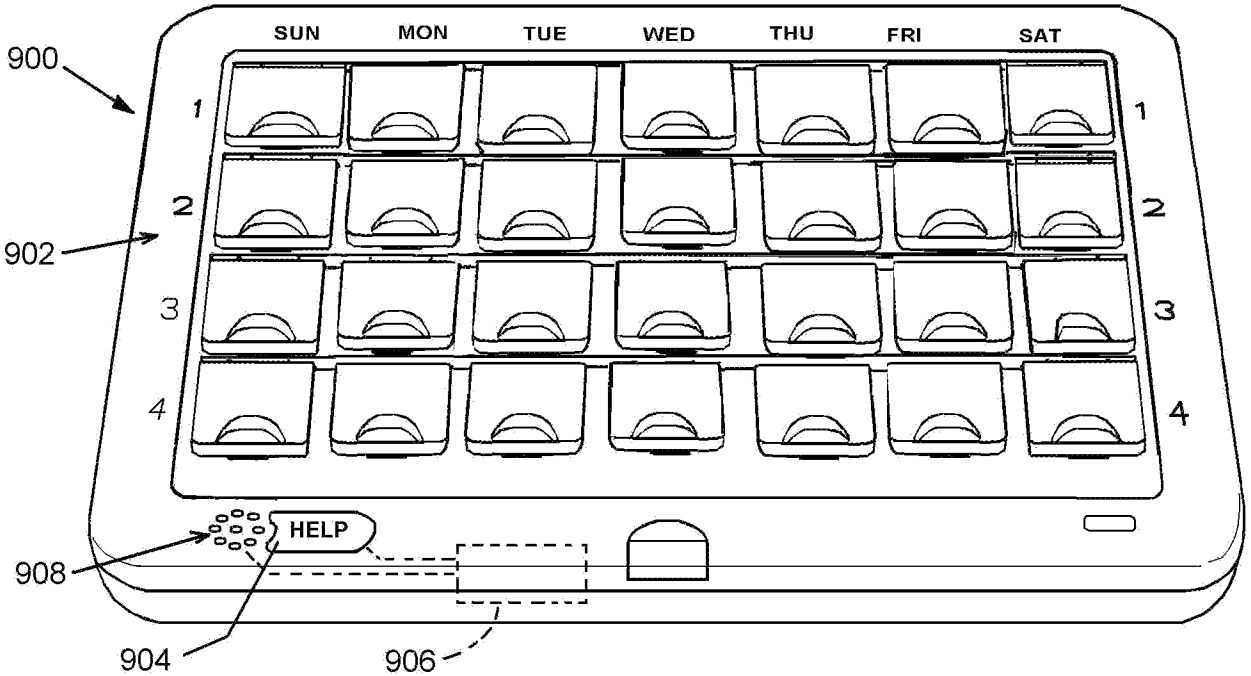
FIG. 9 depicts a communication system built into an illustrative pillbox.

FIG. 9 shows an illustrative embodiment of a pillbox 900 that is provided with an internal communication device. The bezel door cover 902 has an actuator button 904 that communicates to the remote communication system operator (not shown) through a communication link to the pillbox transceiver 906. The combination microphone/speaker 908 integrated with the pillbox facilitates spoken communication with the remote operator. It is expressly contemplated that the alert device can be supplemented with a personally worn actuator that wirelessly communicates through the transceiver 906. In alternate embodiments, the microphone/speaker can (also or alternatively) be built directly into the sides of bottom of the pillbox body. The subscription service costs for the alert system and the pillbox can be combined into a single billing for the convenience of the consumer. The actuator button 904 can be red in color or another color and can be provided with Braille lettering for the visually impaired. In a further embodiment, all interactive buttons, surfaces, doors and lids can be provided with Braille lettering. The microphone/speaker, when combined with a small, board-mount camera (e.g. in the form of a webcam) can provide two-way audio and/or visual communication between the alert subscriber office and the user that can assess the nature of the emergency and the urgency of the situation. At least one of a microphone and a camera on the body for communication by a user with a remote party through a network. The two-way communication can also be used to link the user's next-of-kin (or other designated person) with the user to keep the user calm while emergency technicians are summoned, as well as alerting them to the overall emergency. The two-way communication system can be arranged so that the communication does not require routing through the server and can be arranged to provide direct links. A telephone number or other address/identifier can be entered/dialed directly through the medication dispenser (for example, using a touch screen interface on the media display), and the built-in microphone and speakers provide the mechanisms for the audible two-way communication. In this manner a user is provided with the ability to directly speak with and hear from a service provider or other interested party.

As set forth above, it is contemplated that the interactive medication dispensing system can provide audible, visual and other forms of alerts. In an alternate embodiment, the alert can be provided as a pre-recorded personalized audible and/or visual reminder. The reminder can be recorded by a significant friend and/or relative (for example, an old service buddy or a granddaughter). When the time for the alert is given the prompting reminder to take the dose is in a friendly (or otherwise familiar) voice. This alert can be in the form of a cute little grand-daughter telling the user, "Grandpa, time to take your pills." In addition, the return of the medication cup to the dispensing system can then prompt a gratification message, for example, the same little grand-daughter now saying, "Thank you for taking your medicine, Grandpa, I love you!" Messages of this form can be particularly useful in the case of users that are suffering some form of memory or cognitive impairment.

It is further contemplated that recordable messages can be provided to the pillbox through the server or a third-party based communications device. The recorded messages can include reminders of medical or other appointments, scheduled events, the date (for example, "Grandpa, it's Monday"), or important dates in the user's life (for example, "Happy Birthday", "Lunch Time", "time for bed", etc.). It is expressly contemplated that the recordable messages can include promotional messages from interested third-party providers (for example, "the pharmacy has a 20% off sale today" or "men's slacks are half off today"). The pillbox can be provided with a preset or user-preferenced (e.g. via the remote GUI) filter for content or preferences in third-party providers.

Figure 9A:
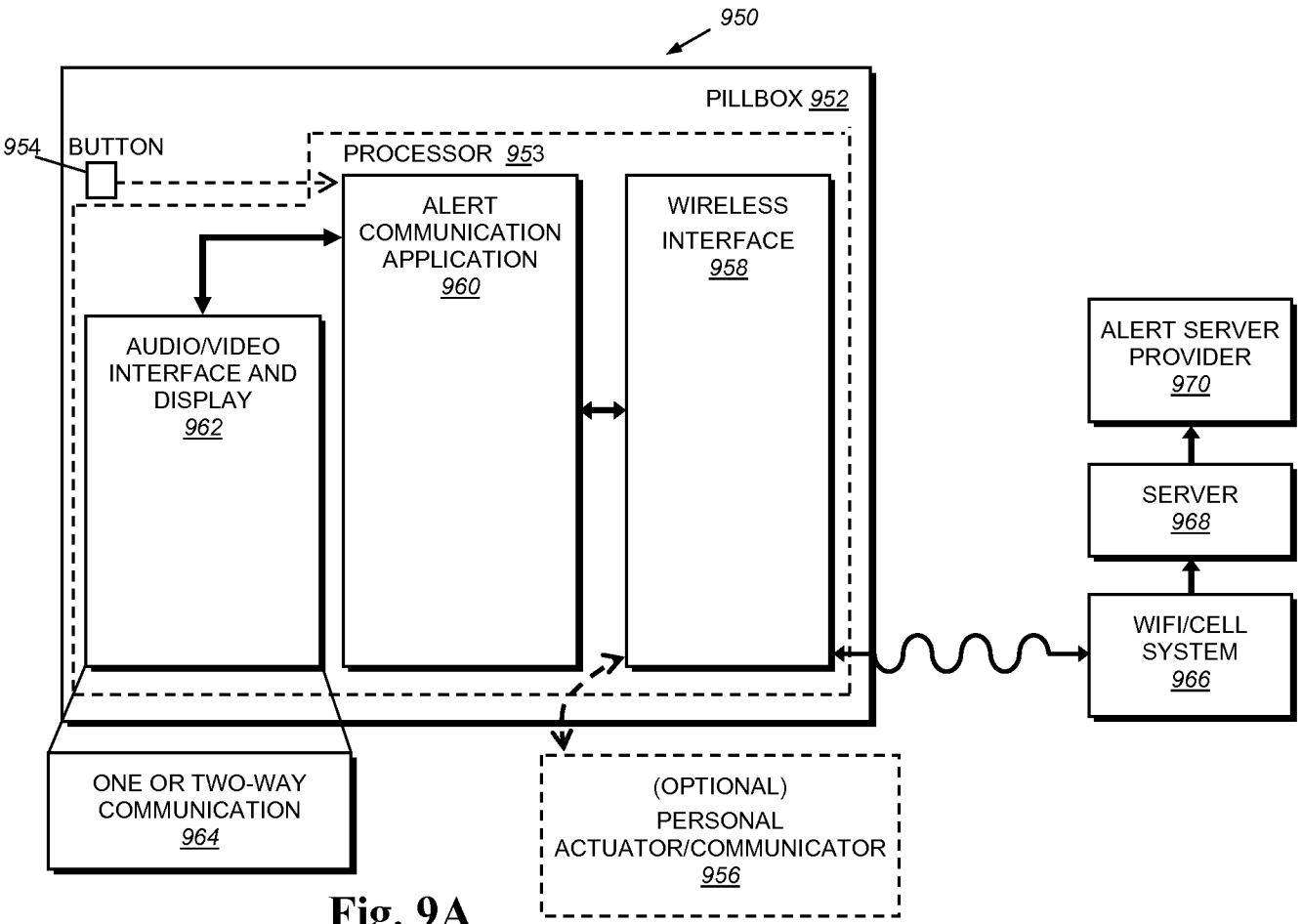
FIG. 9A depicts is a block diagram of an illustrative communication arrangement and associated process for sending an alert to a service provider utilizing the communication system and receiving feedback therefrom.

FIG. 9A is a schematic view of the process for summoning help using the communication system as set forth in FIG. 9 above. The user-generated alerts within illustrative communication system 950 are received by the processor 953, located in the pillbox 952. The alert is triggered by the user, personal caregiver or another person. The alert is transmitted by the button 954 or the optional personal actuator and/or communicator 956 (e.g., a wrist band or key fob). The alert triggers the alert communication application 960. This application 960 allows one-way or two-way communication 964 via the audio/media interface and display 962 of the processor 953. In this manner, a service provider (for example, a medical alert provider that monitors for patient communications via a wearable device, etc.) can carry out a post-alert communication with the user if appropriate to ascertain the user's health status and condition. The pillbox 952 has a wireless receiver that can be tuned to receive alerts using frequencies common to communication devices. Once the processor 953 has received the alert, the alert signal is transmitted wirelessly by the pillbox 952 to a WIFI/cellular telephone system 966 and relayed to the server 968. The alert is then sent to the alert service provider 970 for action. Alternatively, the pillbox can place a direct call to the alert service provider via telephone or the internet. Two-way communications can be achieved between the alert service and the user, either via the internet or telephone. The pillbox can also be provided with a short-range wireless communications device (for example, Bluetooth or equivalent technology). It is expressly contemplated that if a medical provider is viewing the user via a camera and witnesses a potentially dangerous situation, that the provider can initiate the communications system alert if the user is unable to do so.

Figure 10:
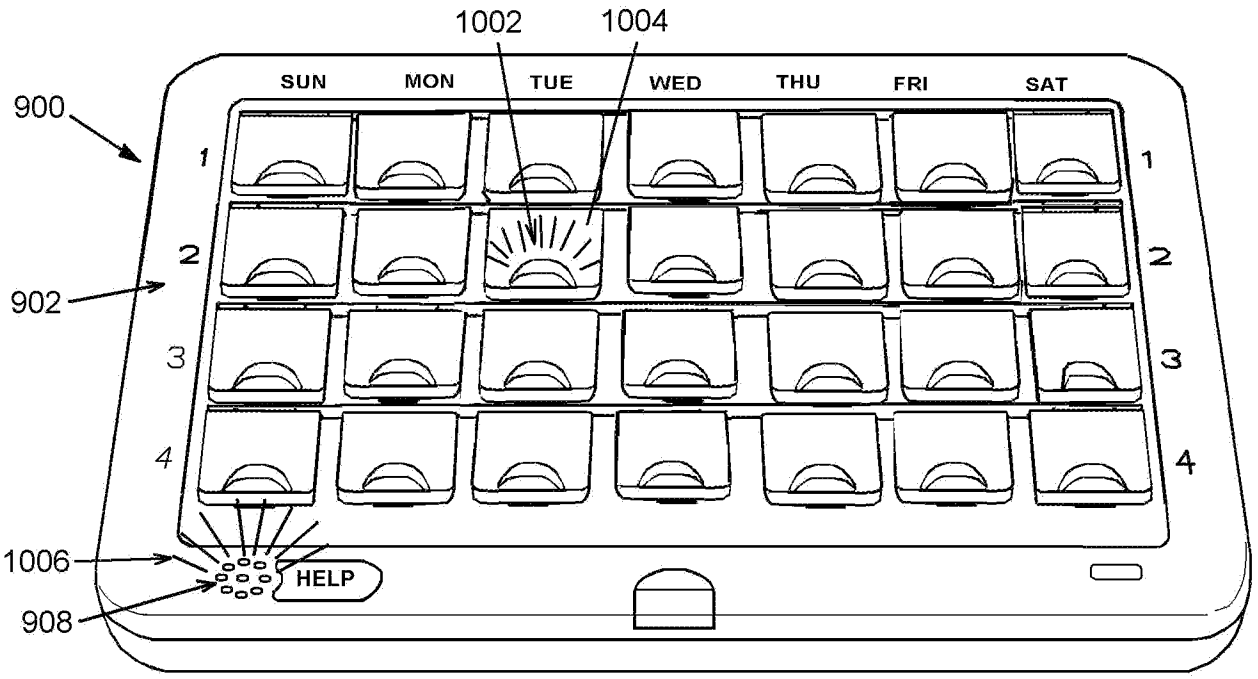
FIG. 10 depicts a pre-recorded alert message in process while an illuminated alert is issued.

FIG. 10 shows an example of a personalized alert being delivered during runtime operation of the pillbox. The medication dispensing system 900 of FIG. 9 has been provided with the microphone/speaker 908 and includes a stored, prerecorded and personalized message. When the alert begins, the particular dose 1002 is indicated by illumination, as set forth above, and the door 1004 will be unlocked. At the same time, the prerecorded message 1006 is emitted from the microphone/speaker 908. When the dosage cup (not shown) has been returned, a gratification message is emitted from the microphone/speaker 908.

The alert and gratification follow-up messages can be recorded by either recording the message into the microphone/speaker 908 or by using the server. This can be facilitated by a telephonic link into the server or by accessing a recording function in the server by way of a local computer having a microphone. This allows for a grandchild or other significant friend or relative to log into the server from a home computer, record alert and gratification messages that are then either transmitted to the medication dispensing system at each alert time via the server's communication link, or that are transmitted once, and stored internally within the digital memory of the medication dispensing system using conventional sound file storage techniques (e.g. a .wav or .mpeg file). This provides as well for a remote updating function for revising messages or substituting the significant friend or relative.

In an embodiment, the medication dispensing system is provided with a visual display, as will be set forth more fully below, it is contemplated that the alert and gratification (follow-up) messages can be visually recorded using a webcam, cellular phone, or similar device on a remote client device or directory on the system. Once recorded, this message then appears on the visual display of the medication dispensing system and serves to reinforce the illuminated dosage alert.

Figure 11:
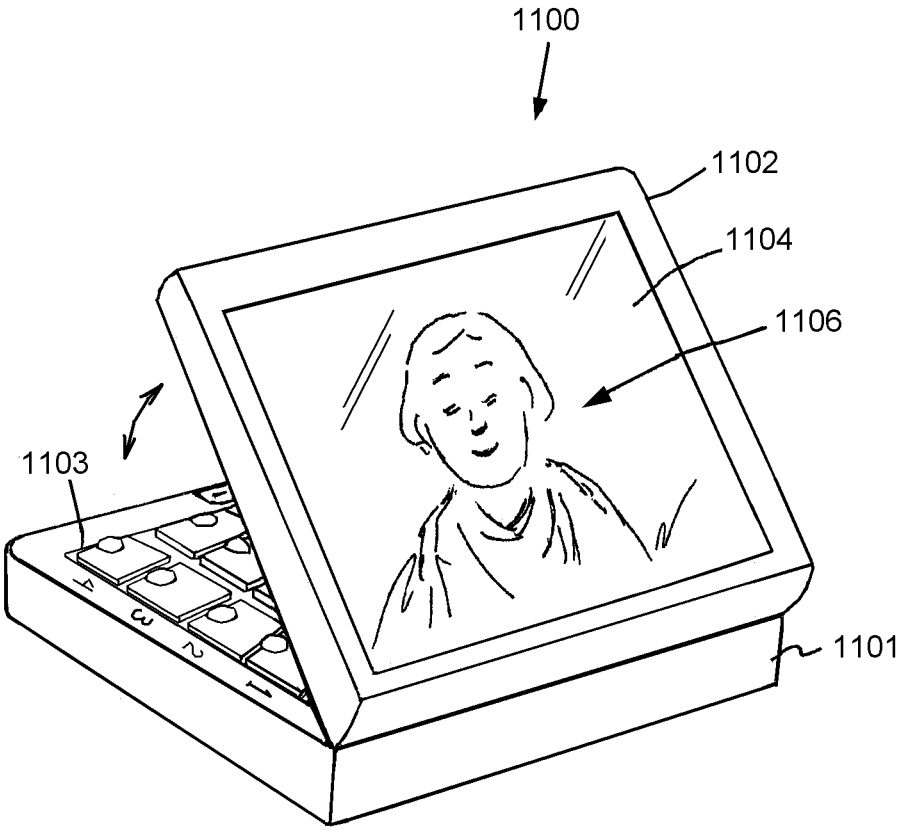
FIG. 11 depicts a pillbox with a visual display incorporated into a lid according to an illustrative embodiment.
Figure 12A:
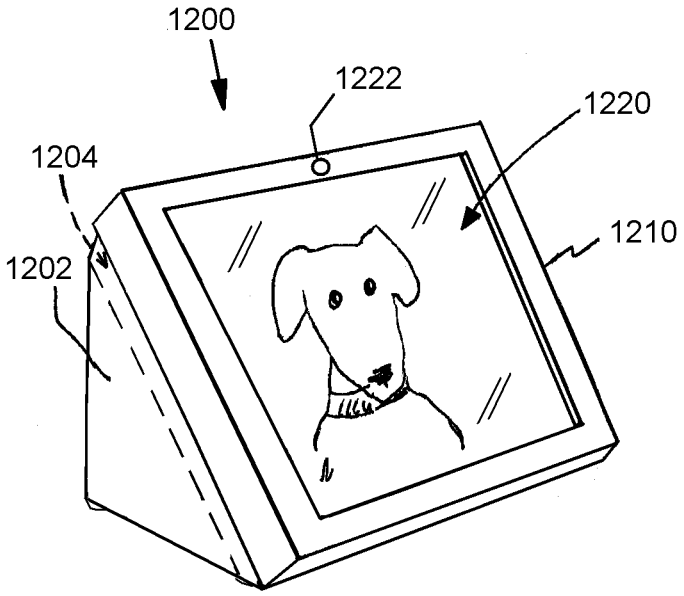
FIG. 12A depicts a pillbox that is mounted at an angle and has a cover that has a built-in visual display according to an illustrative embodiment.
Figure 12B:
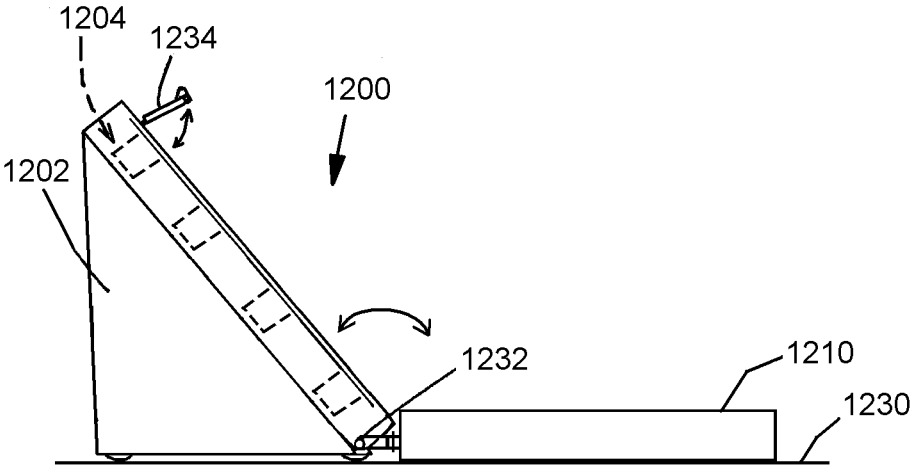
FIG. 12B depicts the pillbox of FIG. 12A with the cover opened for access to the medication cups in an illustrative embodiment.

The miniaturization of visual displays utilizing liquid crystal display (LCD) and similar technologies provides that the medication dispensing system can have a fold-out visual display or a visual display that is mounted onto and/or into one or more of the surfaces of its body for the display of images. FIGS. 11, 12A and 12B depict embodiments that include a visual display that is included in the various surfaces of the medical dispensing system body. The display is movably mounted on the body so as to move between a display position and a cup-accessing position.

FIG. 11 shows a medication dispenser system 1100 having a body 1101 as described above, with an openable/closeable cover 1102 and a refillable tray 1103. The cover 1102 has a visual display 1104 that can function when the lid is closed or raised. The display is constructed and arranged to play at least one of a recorded (a) media reminder message based upon a time in the preprogrammed schedule in which medication is due to be administered and (b) media follow-up message based upon accessing of a predetermined of the cups to obtain a medication to be administered in accordance with the preprogrammed schedule. The screen can be used to display a single image 1106 or to stream a series of images. The image can be interrupted at the alert time to visually display a reminder. In another embodiment, the screen 1104 can be interfaced with a media source and used to stream media output, such as streaming web program, or a digital interface utilizing a touch screen, as will be more fully set forth below. In a further alternate embodiment, the display can present active visual alerts for hearing impaired users (for example, displaying the words "TIME TO TAKE YOUR MEDS") prominently across the screen in a fixed, streaming, flashing, or other motif. In another embodiment, the visual display can be sited on the inside of a cover on the medication dispenser system. This provides a multi-sensory alert system that combines a variety of sensory stimulations for reinforcement of the prescription medication therapy. One advantage of the media screen is that it can be used to selectively cover the pillbox and provide an aesthetically pleasing view to the user. For example, it can display a wallpaper or series of pleasing images in the manner of a screensaver. Conventional hardware and software can be used to drive this display function.

Note that the audio and/or visual playback devices described herein can be driven by conventional driver circuits integrated with the onboard microprocessor (not shown). Such circuits can be implemented in whole, or in part (like other functions described herein) using electronic hardware, software including a non-transitory computer-readable medium of program instructions, or a combination of hardware and software.

FIGS. 12A and 12B are an embodiment in which the medication dispenser system 1200 is provided with an openable/closeable cover 1210 and is placed in a mount 1202 that places the medication tray 1204 at an angle relative to a table top. This angled arrangement allows the medication dispenser system to appear less medical and more of a design feature within the user's personal environment. FIG. 12A shows the medication dispenser system 1200 in a closed configuration. The cover 1210 has a screen that can be used to display a single image 1220, stream a series of images or serve as a digital and/or media interface. The medication dispenser system 1200 is presented herein with a web camera 1222 that can provide two-way visual communication with the service provider. As stated above, the camera can be used as a continuous feed, a clip at the time of medication administration, for sending an alert, status report, response to a questionnaire or other communication need. The display can be a single image, a stream of images or a combination of both. The images can be keyed to the alert time to show more insistent images, or to visually evolve and/or morph into an insistent alert image, followed by a happy gratification image or short image clip. These images can also be animated images and be accompanied by a music clip. The choice of images can be provided by the user for greater personalization, or from a package of images provider by the service provider. The variety of display images and programmed audio visual messages has been developed for compact electronic devices, for example, a laptop computer, represents a plurality of affordable lightweight display options. It is contemplated herein that as these display images become faster and more agile, that the available display options will become greater and more complicated. For example, a flexible display, which can be rolled or folded, can be employed in illustrative embodiments.

FIG. 12B is a side view of the medication dispenser system 1200 in an open configuration with the cover 1210 resting on a level surface 1230. The cover 1210 is secured to the mount 1202 by hinges 1232. In an alternate embodiment, the cover 1210 can be opened partially. The open cover 1210 allows access to the medication tray 1204 and each door 1234.

As set forth above, a visual display can be an interactive digital display that utilizes a touch screen mounted on the medication dispenser system. The interactive display allows a user to interact with the server, request information, report on status, receive reminders of medical appointments, and similar information. For example, a user can use the touch screen to call up the medication schedule, inquire about drug interactions or side effects. The visual display can have a generic interface screen when engaged by a touch and a screen saver image when not engaged.

Figure 13:
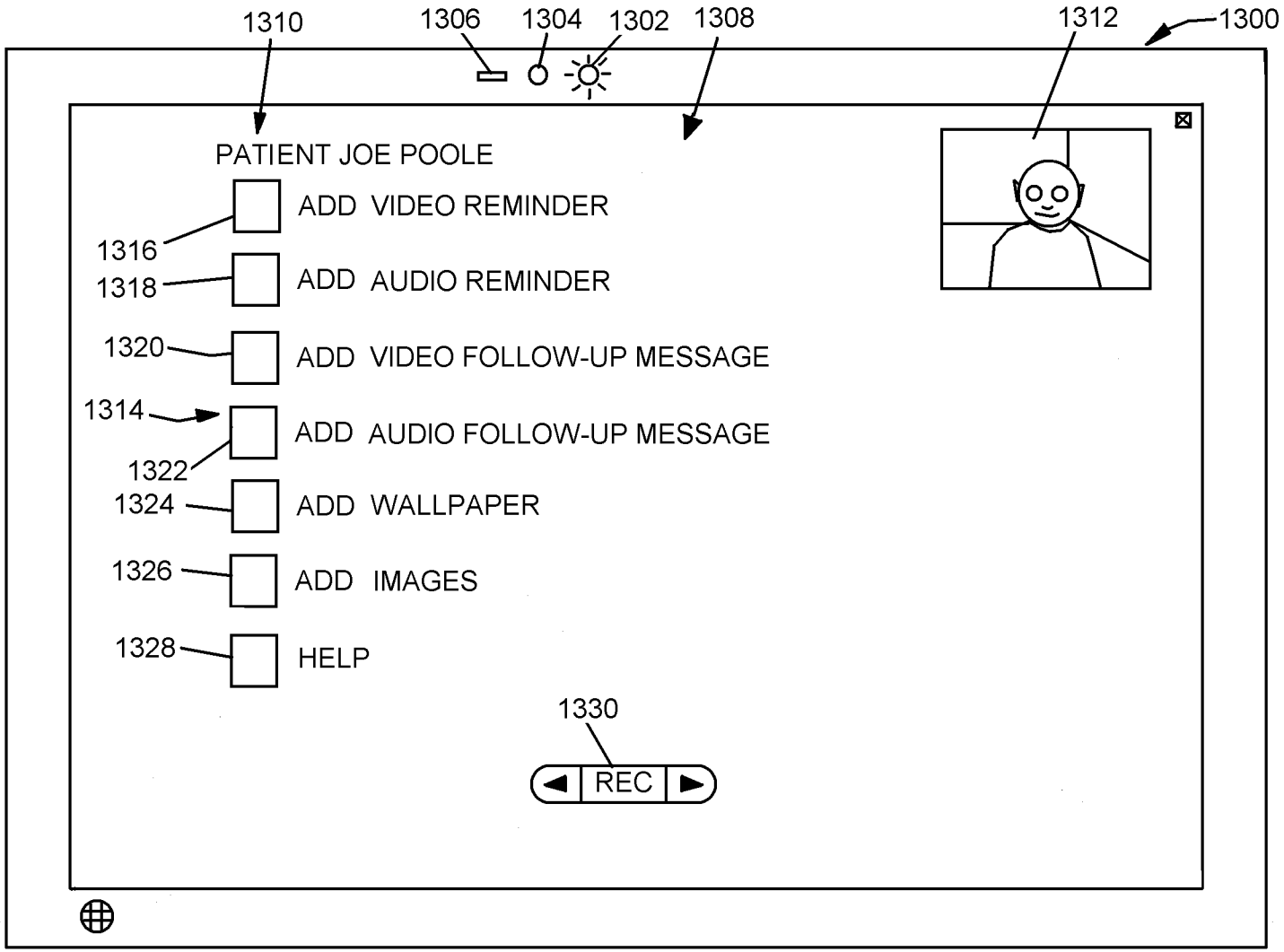
FIG. 13 depicts a graphical user interface (GUI) for personalizing audio and visual effects in connection with the display panel according to an illustrative embodiment.

FIG. 13 shows an illustrative graphical user interface (GUI) associated with the display of a client computer in communication with the server that allows the user or care giver to personalize audio/visual effects in connection with the display panel. A visual display 1300 is provided with an illumination source 1302, camera 1304 and microphone/speaker 1306. The graphical user interface (GUI) screen 1308 is opened on a user's or caregiver's local client computing device and is connected via a web-based or other telecommunication link to the server for relay to the pillbox. The user/caregiver is operating a standard web browser application that supports the graphic user interface. The user is identified 1310 and a screen image 1312 of the user as seen by the camera 1304 is presented at the top for framing purposes when the web camera is in use. The screen options include a plurality of selection icons presented as buttons 1314 that can be activated digitally, with a hand-operated electronic device that controls the coordinates of a cursor or other selector device. At least one of the reminder message and the follow-up message is recorded through the server by a client device and is stored on a memory operatively connected to the processor. The buttons 1314 include a selector for adding a media reminder 1316 or audio reminder 1318 that create the alert message that is emitted at the time for medication administration. Buttons for the media follow-up message 1320 and audio follow-up message 1322 that present the post-administration gratification (follow-up) message.

Additional selections provide for adding or substituting the display wallpaper 1324, adding or substituting images 1326 and a help button 1328. A recording interface 1330 is included in the graphic user interface screen 1308.

Figure 14:
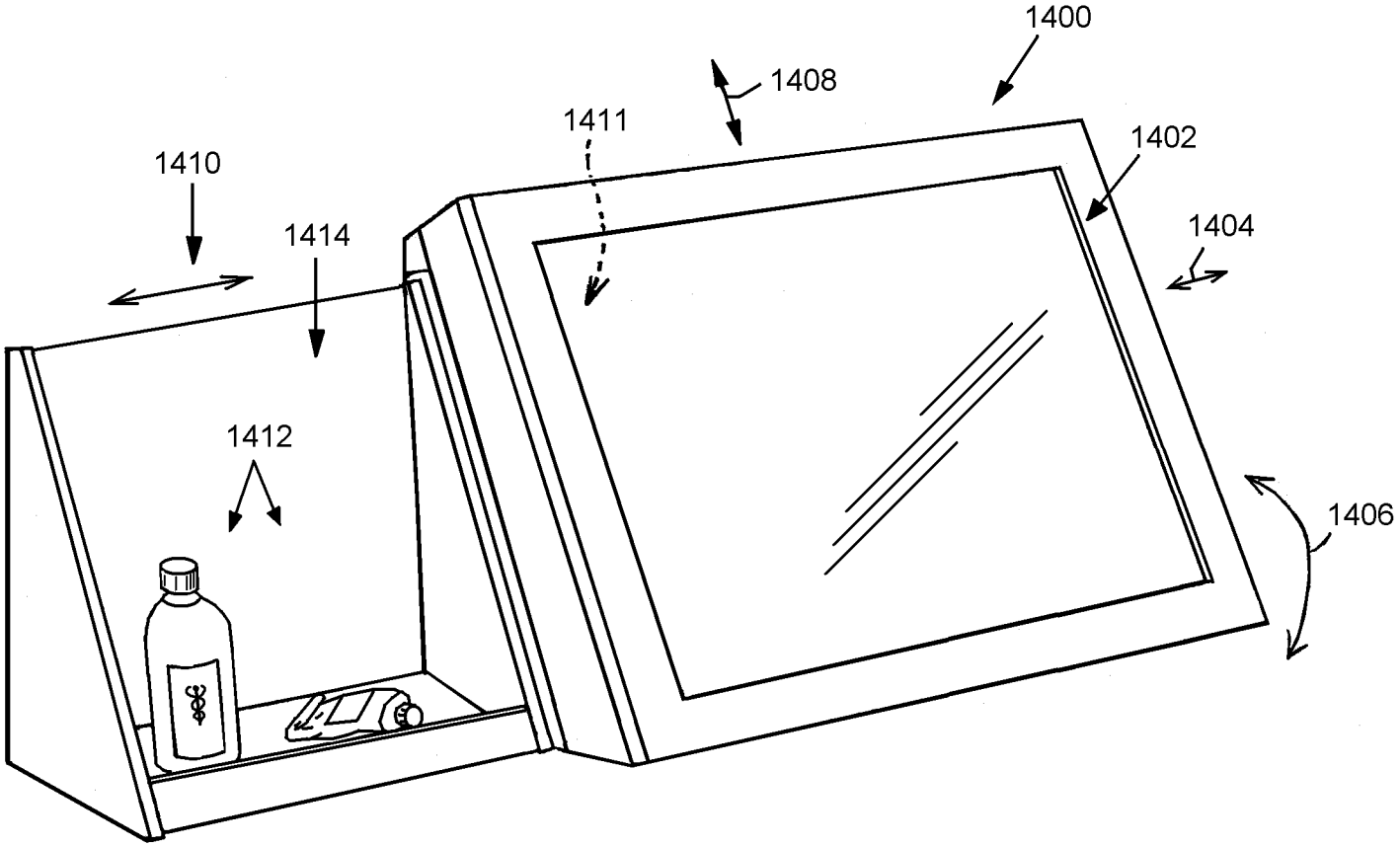
FIG. 14 depicts a pillbox having a display panel and a side-opening drawer according to an illustrative embodiment.

A pillbox 1400 having a display panel 1402 and a side-opening drawer assembly 1410 is shown in FIG. 14 according to an alternate embodiment. The display panel 1402 can be constructed so as to move laterally 1404, opened forward 1406 on a hinge assembly or raised 1408 to provide access to the contents 1412 of the inner compartment 1414 or to a layer of medication compartments 1411 as set forth above. The drawer 1410 can be opened on a side and manually operated, electrically driven or spring-loaded. This system provides storage of medication containers containing larger doses of liquids, ointments or other therapies. The operation of this pillbox can be scheduled, as set forth above, and provided with sensors (not shown) to monitor the completion of removing the medication container and replacing the medication container. It is expressly contemplated that this pillbox can be provided with a built-in refrigeration device for temperature control when temperature-sensitive medications are involved.

Figure 15:
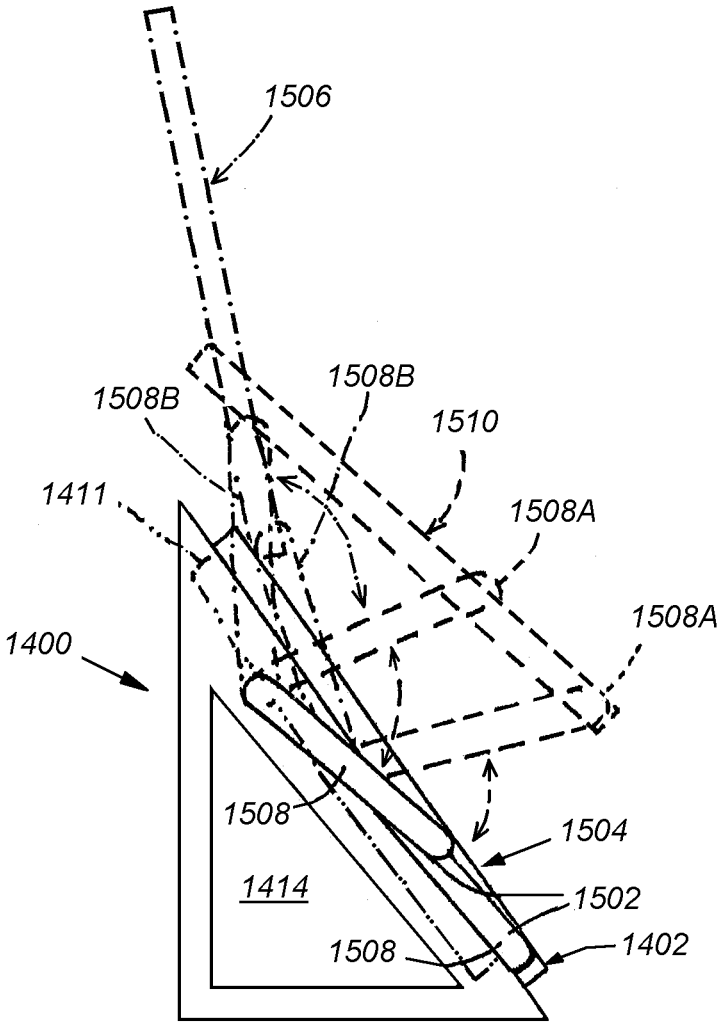
FIG. 15 is a side view of a linkage for use with the pillbox of FIG. 14 and other embodiments herein that allows a display panel to move from a closed position, covering a compartment, to an open position, allowing access to a compartment while it remains facing the user.

A linkage assembly (also briefly referred to as "linkage") 1502 for moving the display 1402 between a closed position 1504 and an open position 1506 is shown in FIG. 15. This linkage is more generally applicable to the pillbox 1400 and any other embodiments (e.g. FIG. 12B above) described above. The linkage assembly 1504 is a dual-bar assembly having pairs of bars 1508 mounted on opposing sides of the display 1402. When the user or care provider has a need to access the medication tray 1411 (shown in broken lines) within the pillbox 1400, the display 1402 is raised from the closed position 1504 through an intermediate position 1510 to the open position 1506 by operation of the linkage 1502. To accomplish this movement, the bars 1508 pivotally rotate to position 1508A and then to position 1508B. Advantageously, the illustrative linkage of FIG. 15 allows the display to remain facing the user at all times whether fully open, partially open or closed, the screen facing user does not occupy extra counter space and leaves space for the drawer. This linkage can include various locks and/or friction devices according to the art that allow it to remain in place when moved to an open position. Alternatively the linkage can be motorized to move between an open and closed position according to skill in the art. Actuation of the motor(s) can be accomplished by a user command (via a button on the pillbox or touch screen button), a remote operator or can occur automatically when a scheduled access time has occurred and/or when the server directs opening of the device—for example when an interested party instructs the device to open remotely.

In an embodiment, the display can include a static or moving image that essentially "points" to the drawer or another movable component of the device (or other embodiments herein). This image can also include various instructions that guide the user through various steps of the drawer opening process, or other processes related to operation of the pillbox.

The depicted graphical user interface (GUI) can be taken by way of an example of a wide variety of various possible implementations. In various embodiments, the screen layout and selection criteria can vary widely in accordance with ordinary skill. The screens can be adjusted in their complexity, text and/or ease of use according to the abilities and mental acuity of the user. Likewise, the various buttons and/or other selection icons can access other interface screens, allowing for the performance of various selected tasks.

The medication dispenser system as described above can be interactive, feature pre-recorded messages and have an interactive touch screen. In a further alternate embodiment, a media camera can be mounted so as to record the administration of medication. In this embodiment, the camera is activated at the time of the alert reminder to take the medication to record the administration of the medication that produces a clip that can be accessed and viewed later to confirm compliance with the therapy regime and potential complications. This also provides remote monitoring by a healthcare professional if desired. The visual display can be fitted with a built-in media camera for two-way communication using a web-based communication system, such as a voice-over-Internet Protocol system (for example, SKYPE® or an equivalent service). This allows interaction between the user and a remote healthcare professional for feedback, therapy questions or messaging. This two-way communication can also be integrated to work with an on-board medic alert system, as described above. Remotely located care givers and interested parties can observe the user to determine personal functionality, overall wellness and observe for possible side effects or interactions of the medication regime.

It is also expressly contemplated that any of the above-described embodiments can include a body having indicia for each of the compartments that are specifically adapted to the user's medication schedule. Thus, while a 4-times daily, 1-week schedule is provided by way of example, the schedule for accessing medication cups is highly variable in other exemplary implementations. For example, in another implementation, the compartments/cups can be arranged to provide four, once-daily dosages or two-twice daily dosages (i.e. each row representing one weekly dose). Other arrangements are expressly contemplated (e.g. once every other day, etc.). The caregiver/interested party can program the schedule to indicate a scheduled medication administration time. The device can be customized by the supplier/manufacturer or by the end user to provide appropriate indicia for the given medication schedule. For example each column can include an indicia for SUN through SAT and the rows can indicate each of four weeks (i.e. WEEK1-WEEK4). In an embodiment, the supplier can provide a self-adhesive overlay with the appropriate indicia. This overlay can be applied to the top of the pillbox. Alternatively, the pillbox can be free of indicia, relying upon the various electronic indicators and messages to direct the user to the proper compartment/cup.

The foregoing has been a detailed description of the illustrative embodiments of the invention. Various modifications and additions can be made without departing from the spirit and scope of this invention. Each of the various embodiments described above can be combined with other described embodiments in order to provide multiple features. Furthermore, while the foregoing describes a number of separate embodiments of the apparatus and method of the present invention, what has been described herein is merely illustrative of the application of the principles of the present invention. For example, the size, shape, color(s), material and thickness of the cups, and the pillbox itself, described herein are highly variable. Likewise, the triggers for various changes in status by the dispensing system are highly variable. For example, the opening of the lid or detection of the presence of a user with respect to a compartment can trigger a change in system status. The systems for providing reminders and alerts, as well as the forms of the reminders and alerts, are highly variable. Likewise, it is expressly contemplated that the particular order of steps used in filling or refilling cups or refillable/refill trays of cups can vary to accommodate various manufacturing processes and/or the needs of pharmacists or users. Accordingly, this description should be taken only by way of example, and not to otherwise limit the scope of the invention.

What is claimed is:

1. A medication dispensing system, comprising:

a body including a bottom housing and a top bezel that movably overlies and is selectively secured over the bottom housing, the bottom housing having a plurality of orifices arranged in a plurality of rows and a plurality of columns, each of the orifices being constructed and arranged to respectively receive each of a plurality of cups, wherein the cups are each sized and arranged to store a plurality of pills therein that collectively define a single dose of medication to be taken by a user at a single corresponding predetermined time, and each include a bottom, sidewalls and an open top, wherein the top bezel includes a plurality of opening that are each respectively aligned with each of the orifices and each respectively surround each of the cups when the top bezel overlies the bottom housing, each of the openings being covered by a hinged lid that is movable by the user between a closed position that covers a respective one of the cups and an opened position that allows access by the user to, and removal of, the one of the cups from a respective one of the orifices, at least a portion of each lid defining a light-transmissive material;

an illuminated, source located respectively within each of the orifices at a position that, when illuminated, transmits light into the portion of the lid;

a sensor switch located with respect to each of the orifices that detects when a respective one of the cups is either present or absent from the respective one of the orifices so as to determine when the respective one of the cups has been removed therefrom;

a circuit within the bottom housing that monitors accessing of each sensor switch and that correlates the monitored state of each sensor switch with respect to a pre-programmed schedule, and provides, in response to the correlation, a signal to the user in the form of illumination of one the illumination source with respect to the one of the orifices in which the single dose is scheduled to be taken by the user at the single corresponding predetermined time; and a communication system having a communication link to a service provider and including an actuator button on the body for communicating with the service provider by the user.

2. The system as set forth in claim 1 wherein the sensor is constructed and arranged to detect when the respective one of the cups is accessed based at least one of (a) when the respective one of the cups is at least one of placed into, removed from or replaced into the orifice (b) when a lid that selectively and movably covers the respective one of the cups is moved from one predetermined orientation to another predetermined orientation.

3. The system as set forth in claim 1, wherein the signal to the user further comprises at least one of an operation of a light, transmission of a sound, generation of a cue, display of a static or moving image on a display interconnected to the bottom housing, or transmission of predetermined information with respect to the monitored state to a server through a network interface located at least in part in the bottom housing and operatively connected with the circuit and a communication network that interconnects the server to the interface.

4. The system as set forth in claim 1, wherein the orifices are arranged with respect to days and times of day.

5. The system as set forth in claim 1, wherein the cups are translucent.

6. The system as set forth in claim 1, wherein the cup is translucent and an illuminated reminder indicator responsive to the signal is located beneath or around the cup so as to transmit light into and through the cup in the manner of a light pipe and into the lid.

7. The system as set forth in claim 3, wherein the circuit is operatively connected, either wired or wirelessly, to a server constructed and arranged to enable programming and reprogramming of the configuration.

8. The system as set forth in claim 7, wherein the circuit monitors the accessing of discrete cups and generates compliance data by determining the accessing by the user of each of the cups at scheduled times according to a predetermined medication schedule and reports the compliance data to the server for access by an interested party.

9. The system as set forth in claim 7, wherein the body includes a bezel door that overlies the bottom housing and selectively covers each of the cups and wherein the server is constructed and arranged to report to a recipient information related to the opening and closing of the bezel door.

10. The system as set forth in claim 7, wherein server is constructed and arranged to report to the recipient information related to at least one of:

(a) removal of each of the cups with respect to the configuration; or (b) replacement of each of the cups with respect to the configuration; or (c) refilling of a plurality of the cups with respect to the configuration; or (d) where the cups are provided on a refillable tray that is replaced in its entirety, the replacement of the refillable tray with respect to the configuration; or (e) movement of each lid from the one predetermined orientation to the other predetermined orientation.

11. The system as set forth in claim 7, wherein the circuit is constructed and arranged to operate in accordance with a recent programmed configuration upon a disconnection of the communication network from the server.

12. The system as set forth in claim 1, further comprising a multisensory illuminated reminder system comprising a plurality of lights, each of the lights being located with respect to each of the plurality of cups, respectively and an audible pre-recorded alert message, followed after administration, by a follow-up message.

13. The system as set forth in claim 1 wherein the communication system further comprises a wireless link for actuation by a remote device.

14. The system as set forth in claim 1 further comprising a server that communicates with an interested party and that is interconnected via a communication link with the circuit through a network interface, the server being constructed and arranged to control the pre-programmed schedule by the interested party and enable monitoring by the interested party of access of cups and a status of the system.

15. The system as set forth in claim 14 wherein the server is constructed and arranged to route signals from the communication system to the service provider.

16. The system as set forth in claim 1, further comprising a display device mounted on the body for display of at least one of static and moving images.

17. The system as set forth in claim 16 wherein the display is movably mounted on the body so as to move between a displaying position and a cup-accessing position.

18. The system as set forth in claim 16 wherein the display is constructed and arranged to play at least one of a recorded (a) at least one of an audio, visual and media reminder message, and (b) at least one of an audio, visual and media follow-up message based upon accessing of a predetermined of the cups to obtain a medication to be administered in accordance with the pre-programmed schedule.

19. The system as set forth in claim 15 wherein at least one of the reminder message and the follow-up message is recorded through a server by a client device and is stored on a memory operatively connected to the circuit.

20. The system as set forth in claim 15 wherein the body includes at least one of (a) a camera for acquiring images and (b) a built-in microphone assembly and a speaker assembly, the built-in microphone assembly and the speaker assembly being constructed and arranged to enable two-way communication between a user and at least one of an interested party and the service provider by at least one of (i) the communication system and (ii) a third party communication network.

21. The system as set forth in claim 1 further comprising, operatively connected to the body, a messaging system that provides at least one of audible, pictorial, textual and media messages to the user over at least one of the communication network and a third party network, and wherein the communication system constructed and arranged to deliver messages from the user over at least one of the communication network and the third party network.

* * * * *